US012338566B2

(12) United States Patent
Kumon et al.

(10) Patent No.: US 12,338,566 B2
(45) Date of Patent: Jun. 24, 2025

(54) CASE AND WASHING MACHINE

(71) Applicant: SHARP KABUSHIKI KAISHA, Osaka (JP)

(72) Inventors: Yui Kumon, Osaka (JP); Masaru Misumi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 167 days.

(21) Appl. No.: 18/037,302

(22) PCT Filed: Nov. 15, 2021

(86) PCT No.: PCT/JP2021/041814
§ 371 (c)(1),
(2) Date: May 16, 2023

(87) PCT Pub. No.: WO2022/107703
PCT Pub. Date: May 27, 2022

(65) Prior Publication Data

US 2024/0018713 A1 Jan. 18, 2024

(30) Foreign Application Priority Data

Nov. 17, 2020 (JP) ..... 2020-190891

(51) Int. Cl.
*D06F 39/02* (2006.01)

(52) U.S. Cl.
CPC ..... *D06F 39/02* (2013.01)

(58) Field of Classification Search
CPC ..... D06F 39/02
USPC ..... 68/12.18
See application file for complete search history.

(56) References Cited

U.S. PATENT DOCUMENTS 2,431,040 A 11/1947 Harvey

FOREIGN PATENT DOCUMENTS

| | | | |
|---|---|---|---|
| JP | S5513550 | U | 1/1980 |
| JP | H11290581 | A | 10/1999 |
| JP | 2014176447 | A | 9/2014 |
| JP | 2015192771 | A | 11/2015 |

OTHER PUBLICATIONS

JPH11290581A—machine translation (Year: 1999).*
JPS55013550—machine translation (Year: 1980).*

* cited by examiner

*Primary Examiner* — Tinsae B Ayalew
(74) *Attorney, Agent, or Firm* — ScienBiziP, P.C.

(57) ABSTRACT

The case accommodates the washing treatment agent to be dispensed to a washing machine tank of the washing machine. The case includes a main body portion and a water supply portion. The main body portion includes a bottom portion that receives the washing treatment agent. The water supply portion supplies water to the main body portion. The bottom portion includes an upper surface including one end portion, the one end portion being positioned above another end portion in a first direction. The upper surface includes an inclined portion having a first gradient varying in the first direction, the first gradient indicating a ratio of a distance in a vertical direction to a distance in the first direction.

11 Claims, 29 Drawing Sheets

CASE AND WASHING MACHINE

TECHNICAL FIELD

The present invention relates to a case and a washing machine. The present application claims priority from JP 2020-190891 filed in Japan on Nov. 17, 2020, the content of which is hereby incorporated by reference into this application.

BACKGROUND ART

In recent years, attention has been focused on technologies that mimic and thereby utilize the diverse functions of organisms, that is, biomimetics. Nature Technology (trademark) is known as an example of manufacturing that employs such a biomimetic technology in, for example, electrical products.

In the related art, a washing machine including a detergent case (case) with an accommodation chamber for accommodating a detergent (washing treatment agent) has been disclosed (for example, see PTL 1).

The washing machine in PTL 1 includes the detergent case in which a first accommodation chamber for accommodating a detergent is formed, and a flow path structure portion that forms a flow path above the detergent case. A plurality of flow-down holes for directing water in the flow path toward the detergent case are formed in the flow path structure portion. The detergent case includes a dividing wall that divides the first accommodation chamber into a mixing chamber for generating an aqueous solution of the detergent by mixing the detergent and the water, and a frothing chamber for frothing the aqueous solution that flows in from the mixing chamber.

CITATION LIST

Patent Literature

PTL 1: JP 2015-192771 A

SUMMARY OF INVENTION

Technical Problem

The washing treatment agent may remain in the case without being dissolved in the water.

The present disclosure provides a case and a washing machine that can minimize residual washing treatment agent.

Solution to Problem

A case according to an aspect of the present disclosure accommodates a washing treatment agent to be dispensed to a washing machine tank of a washing machine. The case includes a main body portion and a water supply portion. The main body portion includes a bottom portion that receives the washing treatment agent. The water supply portion supplies water to the main body portion. The bottom portion includes an upper surface including one end portion in a first direction, the one end portion being positioned above another end portion. The upper surface includes an inclined portion having a first gradient varying in the first direction, the first gradient indicating a ratio of a distance in a vertical direction to a distance in the first direction.

A washing machine according to an aspect of the present disclosure includes the case and the washing machine tank into which the washing treatment agent accommodated in the case is dispensed together with water.

DESCRIPTION OF EMBODIMENTS

Embodiments and modified examples described below are merely examples of the disclosure, and the disclosure is not limited to the embodiments and modifications. Besides the embodiments and modified examples, various changes are possible depending on the design and the like, unless the changes deviate from the technical concept of the disclosure.

Embodiments

Figure 1:
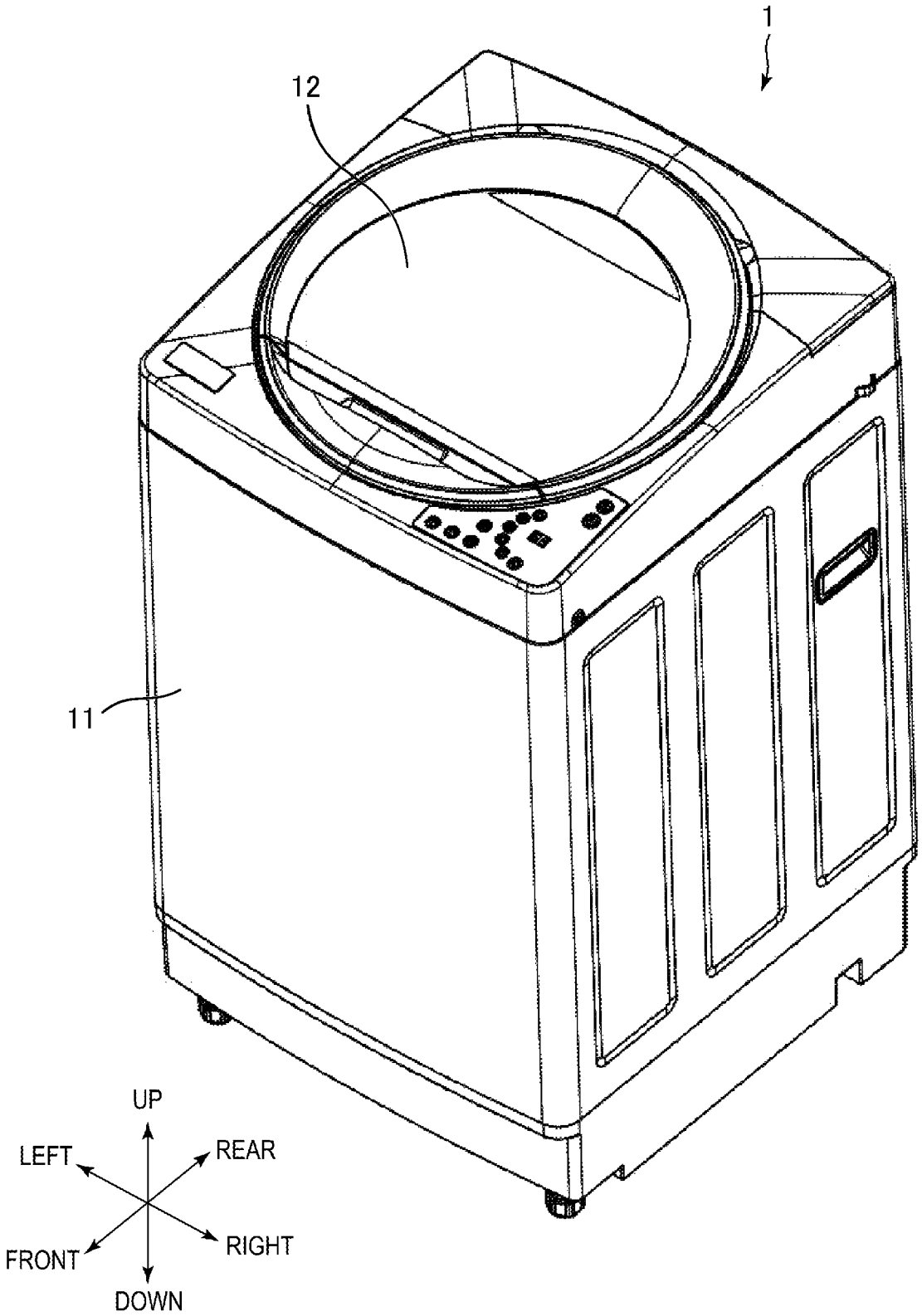
FIG. 1 is an external perspective view illustrating a washing machine according to an embodiment.
Figure 2:
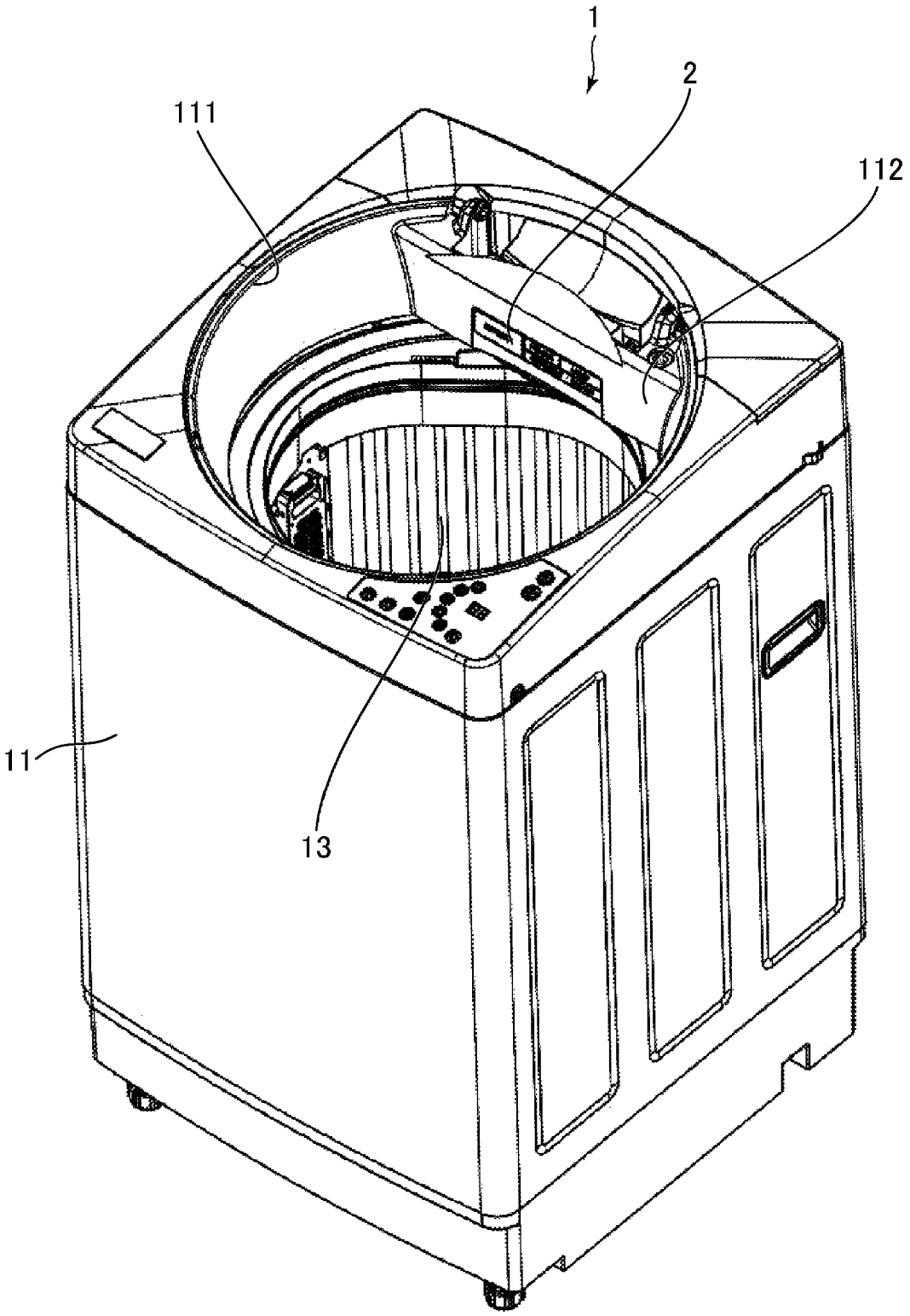
FIG. 2 is an enlarged perspective view of the washing machine with an upper lid removed.

A washing machine 1 according to the present embodiment and a case 2 used in the washing machine 1 will be described below with reference to FIGS. 1 to 16. The following description will be made with reference to up, down, left, right, front, and rear directions illustrated in FIG. 1. However, these directions are merely defined for convenience of description and are not intended to limit directions in use.

The washing machine 1 according to the present embodiment includes a housing 11, an upper lid 12, a washing machine tank 13, and the case 2.

The housing 11 is formed in a rectangular tube shape. The washing machine tank 13 and the case 2 are accommodated in the housing 11. An opening portion 111 is formed in the upper surface of the housing 11. A user can put laundry in and take laundry out of the washing machine tank 13 through the opening portion 111.

The upper lid 12 is configured to open and close the opening portion 111 of the housing 11. The upper lid 12 is configured to open and close the opening portion 111 of the housing 11 by pivoting about a rotation shaft provided at a rear end portion 313 of the upper lid 12, extending along the left-right direction.

The washing machine tank 13 is formed in a cylindrical shape and has an opening at an upper portion and a bottom portion at a lower portion. The washing machine tank 13 is disposed such that the opening is continuous with the opening portion 111 of the housing 11 in the vertical direction. A washing treatment agent is dispensed to the washing machine tank 13 together with water. Examples of the washing treatment agent include a detergent and a fabric softener. An agitating unit is provided at the bottom portion of the washing machine tank 13. The agitating unit can rotate relative to the washing machine tank 13. The agitating unit rotates to agitate laundry together with, for example, a detergent aqueous solution in which a detergent is dissolved in water. Thus, laundry is washed. The washing treatment agent to be dispensed to the washing machine tank 13 is accommodated in the case 2.

The case 2 is provided in the housing 11. Specifically, the case 2 is provided so as to be exposed from a back panel 112 of the housing 11. The back panel 112 is provided between the opening portion 111 of the housing 11 and the opening of the washing machine tank 13 in the vertical direction. The back panel 112 is provided such that one surface of the back panel 112 formed along the vertical direction and the left-right direction faces forward.

The case 2 is a pull-out container and is configured to be pulled out forward from the back panel 112. A user can pull out the case 2 from the back panel 112 and put the washing treatment agent in the case 2. In a state where the case 2 is housed in the back panel 112, water is supplied from above to the washing treatment agent accommodated in the case 2. As a result, the washing treatment agent accommodated in the case 2 is dissolved in the water, discharged from the case 2, and dispensed to the washing machine tank 13 together with the water.

Here, examples of the washing treatment agent according to the present disclosure include a detergent, a fabric softener, and a bleach. Types of the detergent include a liquid detergent in a liquid form and a powder detergent in a powder form. That is, the washing treatment agent includes a powder detergent. Powder detergent is less soluble in water and is less likely to be discharged from the case 2 than liquid detergent. The case 2 according to the present embodiment has the following configuration, which can minimize residual washing treatment agent even when the washing treatment agent is a powder detergent.

Figure 3:
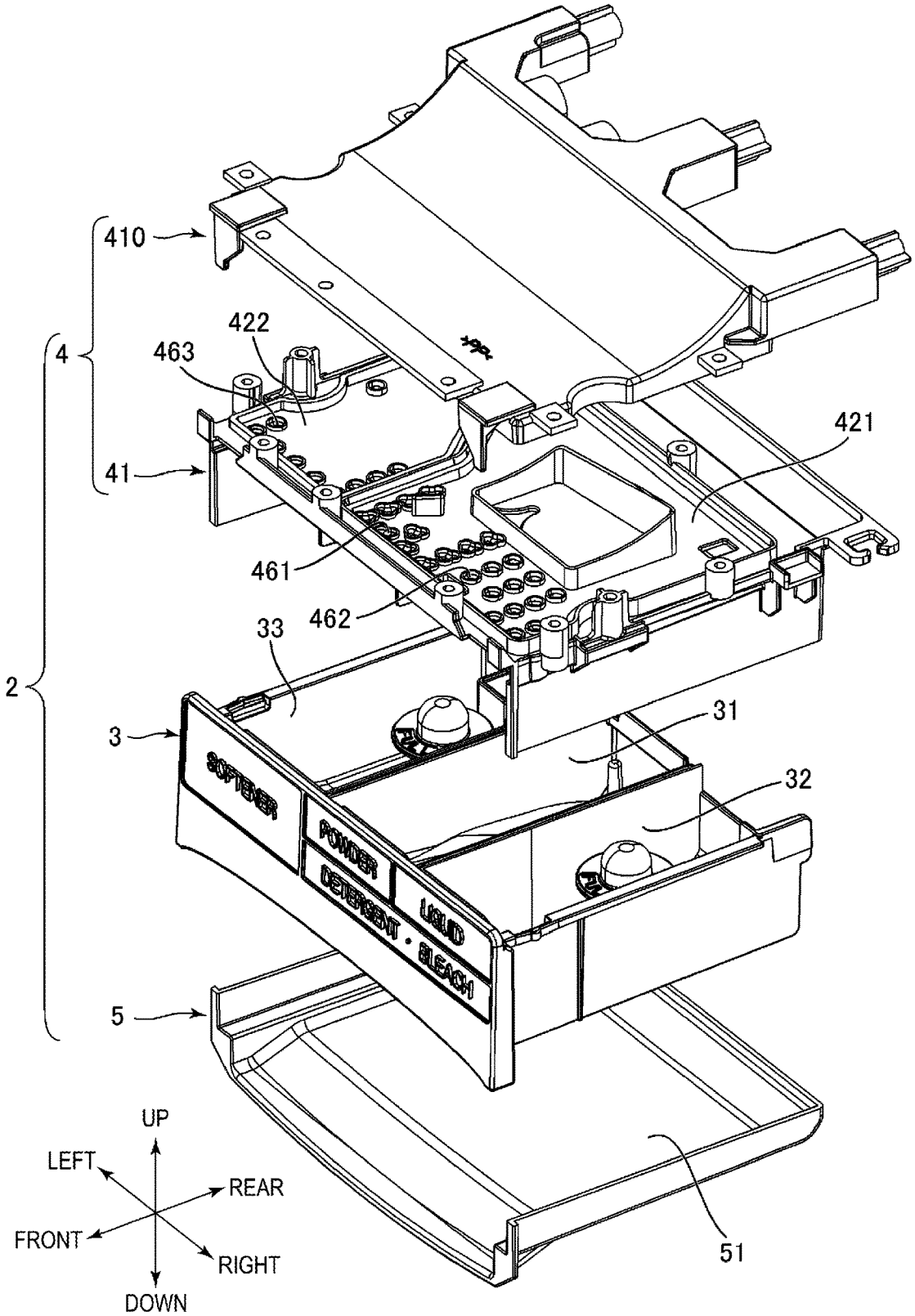
FIG. 3 is an exploded perspective view of a case used in the washing machine.

As illustrated in FIG. 3, the case 2 according to the present embodiment includes a main body portion 3, a water supply portion 4, and a bottom cover 5.

The main body portion 3 is open at the top and is configured to receive the washing treatment agent. Specifically, the main body portion 3 is formed in a rectangular box shape with an open top. The main body portion 3 is configured to be pulled out forward from the back panel 112.

Figure 4:
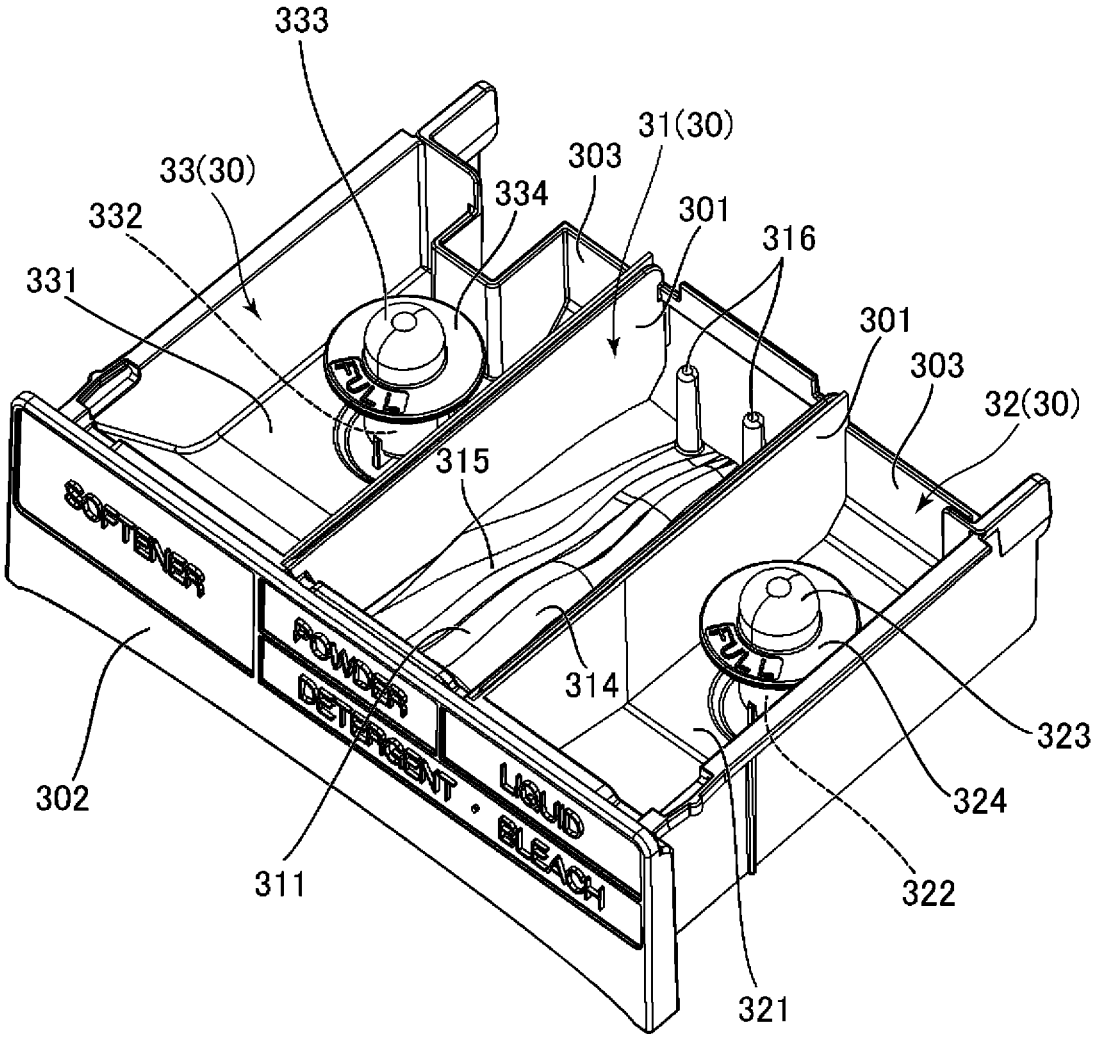
FIG. 4 is an external perspective view of a main body portion of the case.

As illustrated in FIG. 4, the internal space of the main body portion 3 is partitioned into three by two partition walls 301. Each partition wall 301 is formed in a plate shape in which the left-right direction is a thickness direction. The partition wall 301 is formed over a front wall 302 and a rear wall 303, which are parts of a peripheral wall defining the internal space of the main body portion 3. The two partition walls 301 are formed apart from each other in the left-right direction. The internal space of the main body portion 3 is partitioned in the left-right direction by the two partition walls 301, so that three accommodation chambers 30 are formed side by side in the left-right direction. When the three accommodation chambers 30 are distinguished from each other, the central accommodation chamber 30 is referred to as a first accommodation chamber 31, the right accommodation chamber 30 is referred to as a second accommodation chamber 32, and the left accommodation chamber 30 is referred to as a third accommodation chamber 33.

The three accommodation chambers 30 are assumed to accommodate different types of washing treatment agents. The first accommodation chamber 31 and the second accommodation chamber 32 are assumed to accommodate a detergent or a bleach as the washing treatment agent, and the third accommodation chamber 33 is assumed to accommodate a fabric softener as the washing treatment agent. Specifically, a powder detergent or bleach is accommodated in the first accommodation chamber 31. A liquid detergent or bleach is accommodated in the second accommodation chamber 32. A liquid fabric softener is accommodated in the third accommodation chamber 33. The present embodiment will be described on the assumption that a powdery detergent (powder detergent) is accommodated in the first accommodation chamber 31 as the washing treatment agent. In the following description, the washing treatment agent accommodated in the first accommodation chamber 31 may be referred to as a powder detergent.

Figure 5:
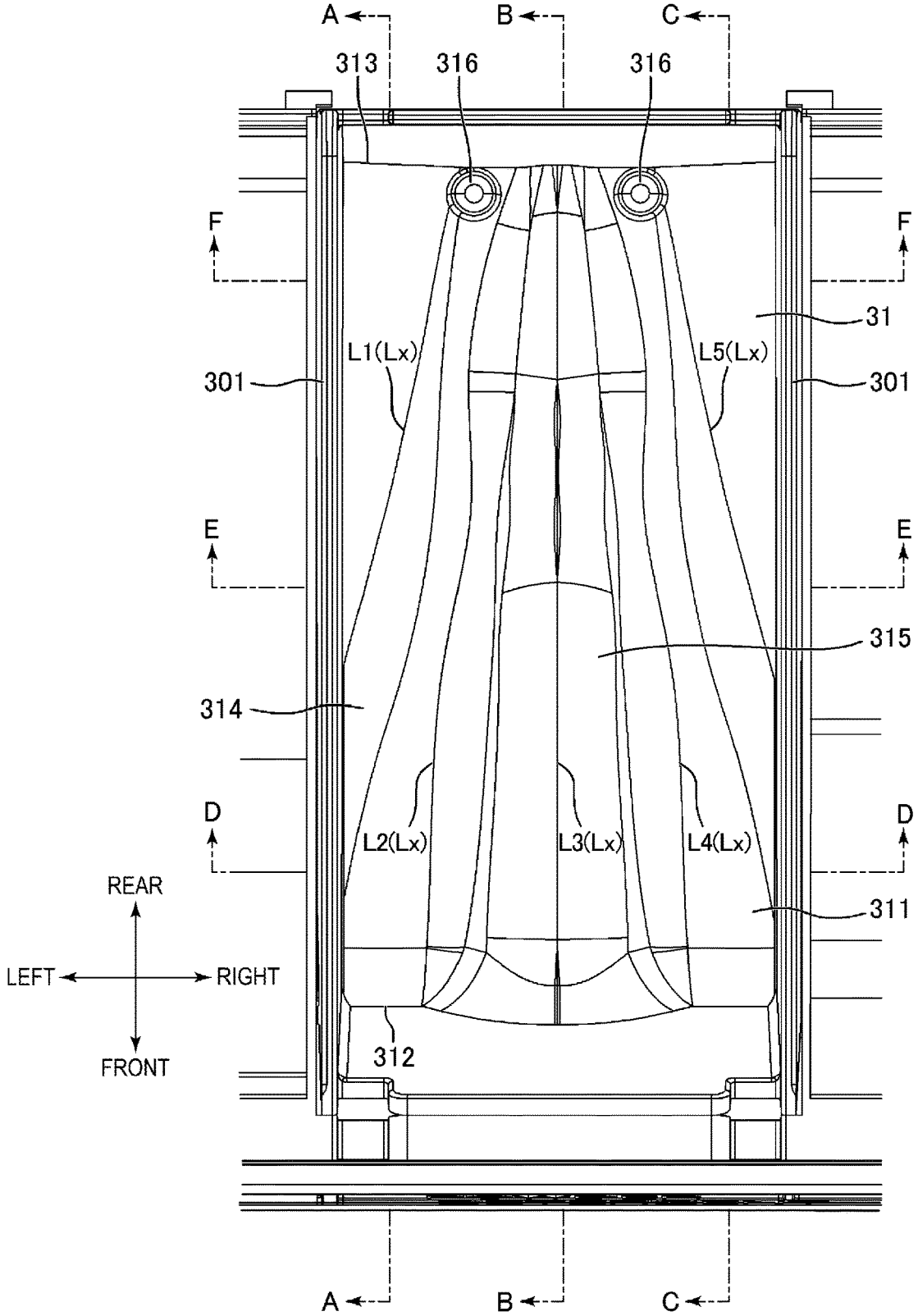
FIG. 5 is a plan view of a first accommodation chamber of the main body portion.
Figure 6:
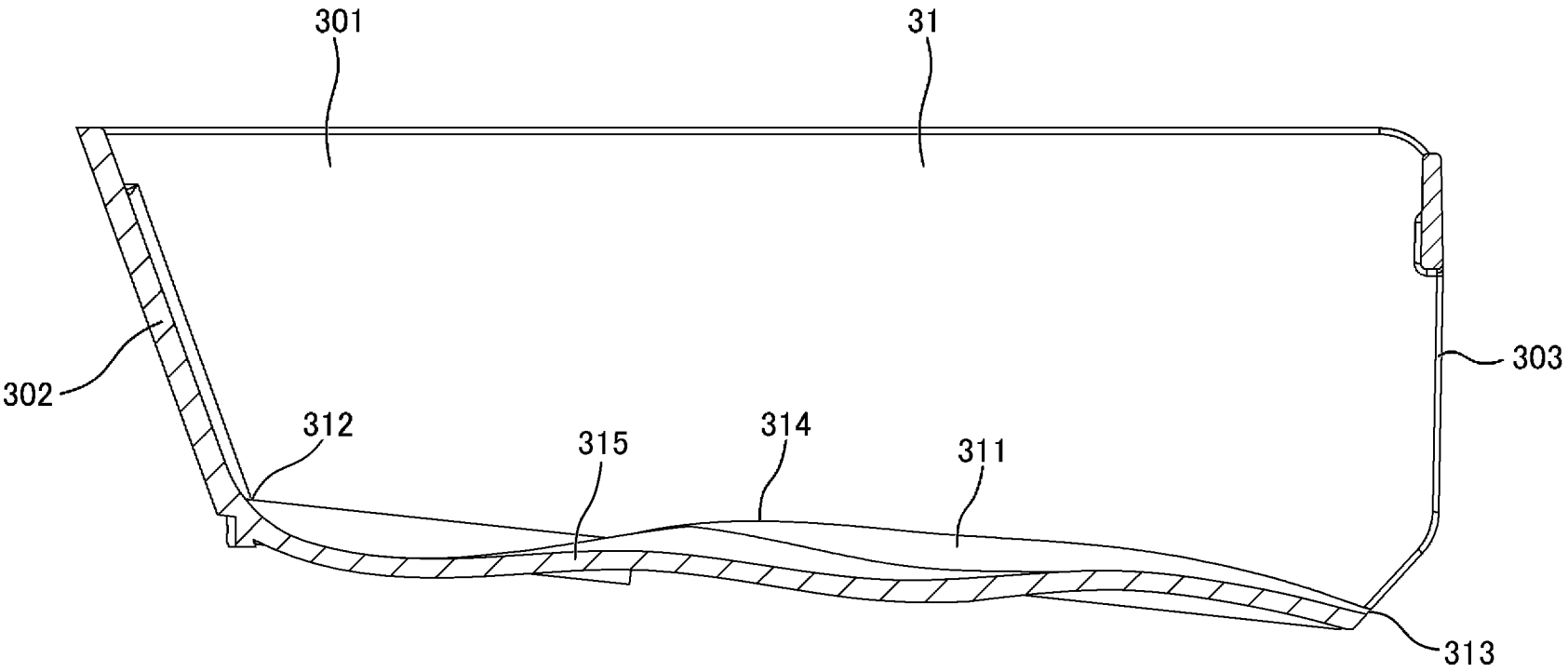
FIG. 6 is a cross-sectional view taken along line A-A in FIG. 5.
Figure 7:
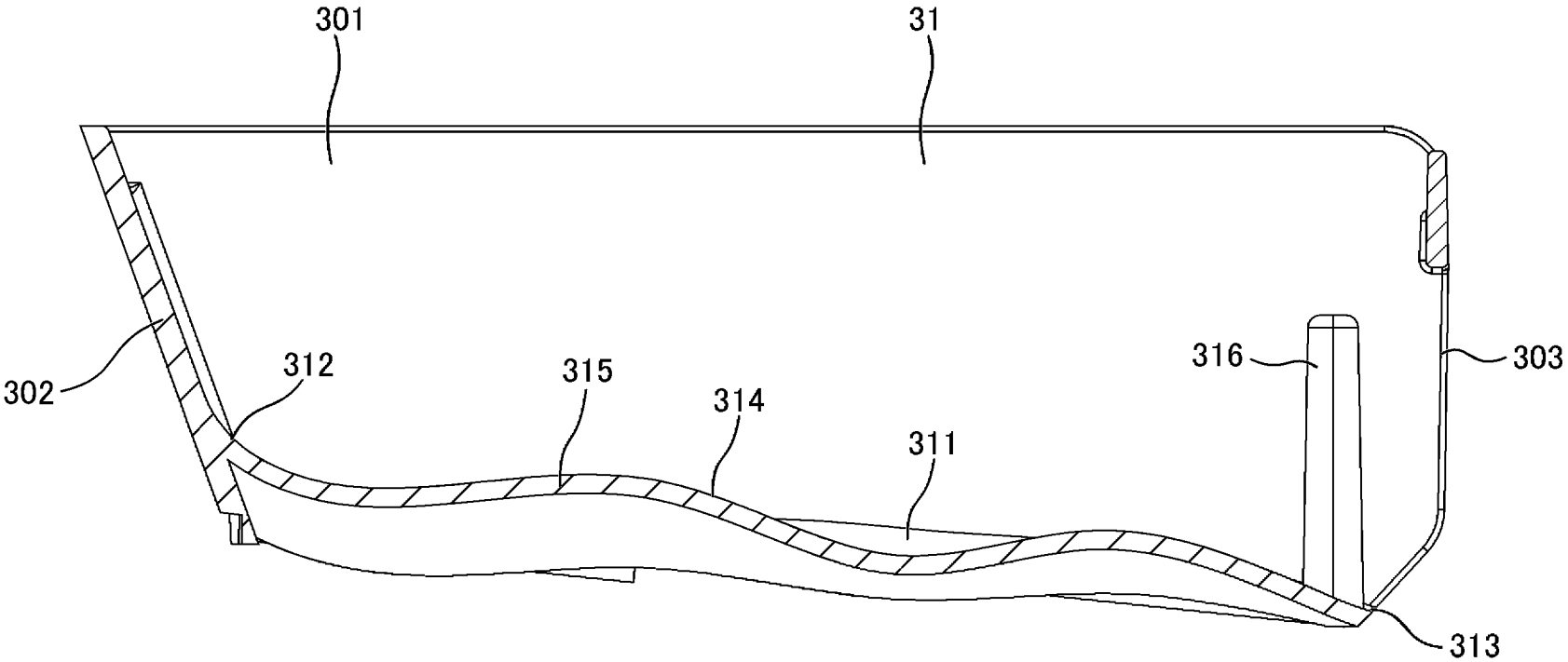
FIG. 7 is a cross-sectional view taken along line B-B in FIG. 5.
Figure 8:
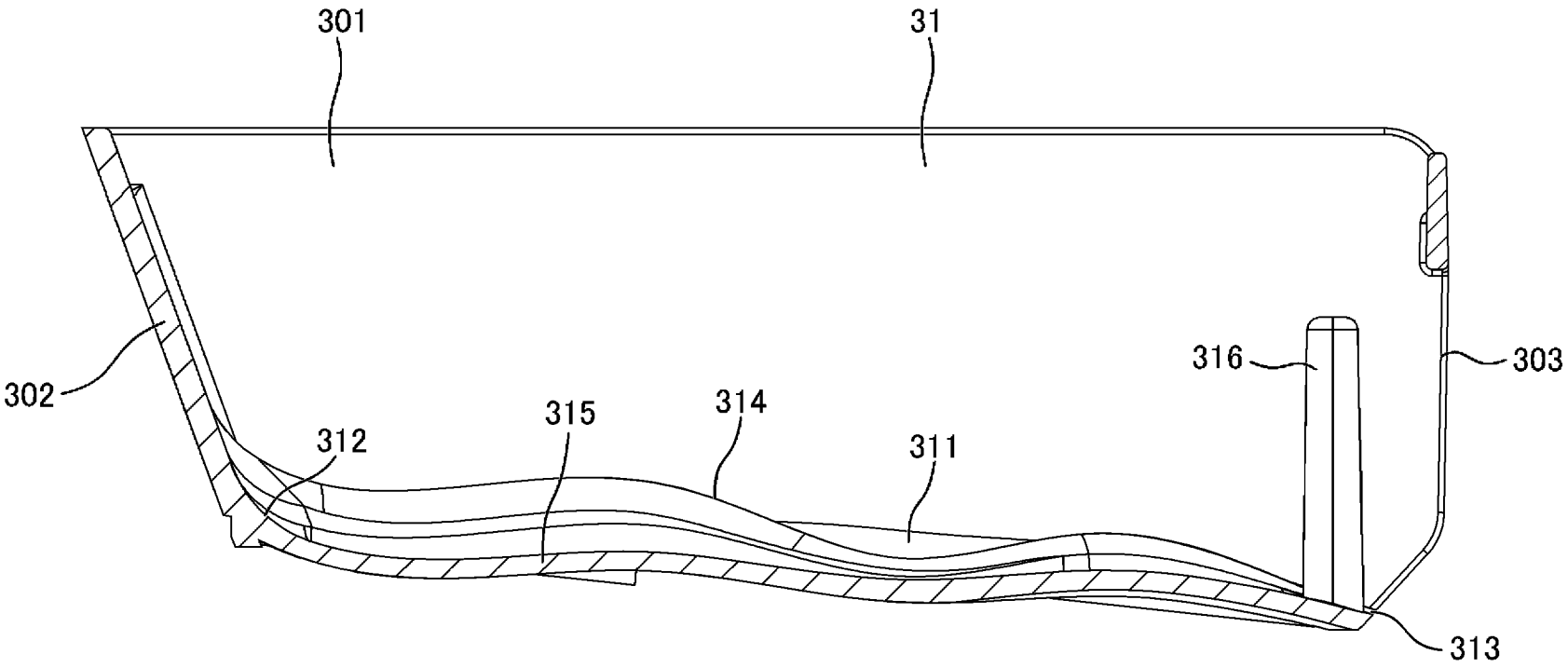
FIG. 8 is a cross-sectional view taken along line C-C in FIG. 5.
Figure 9:
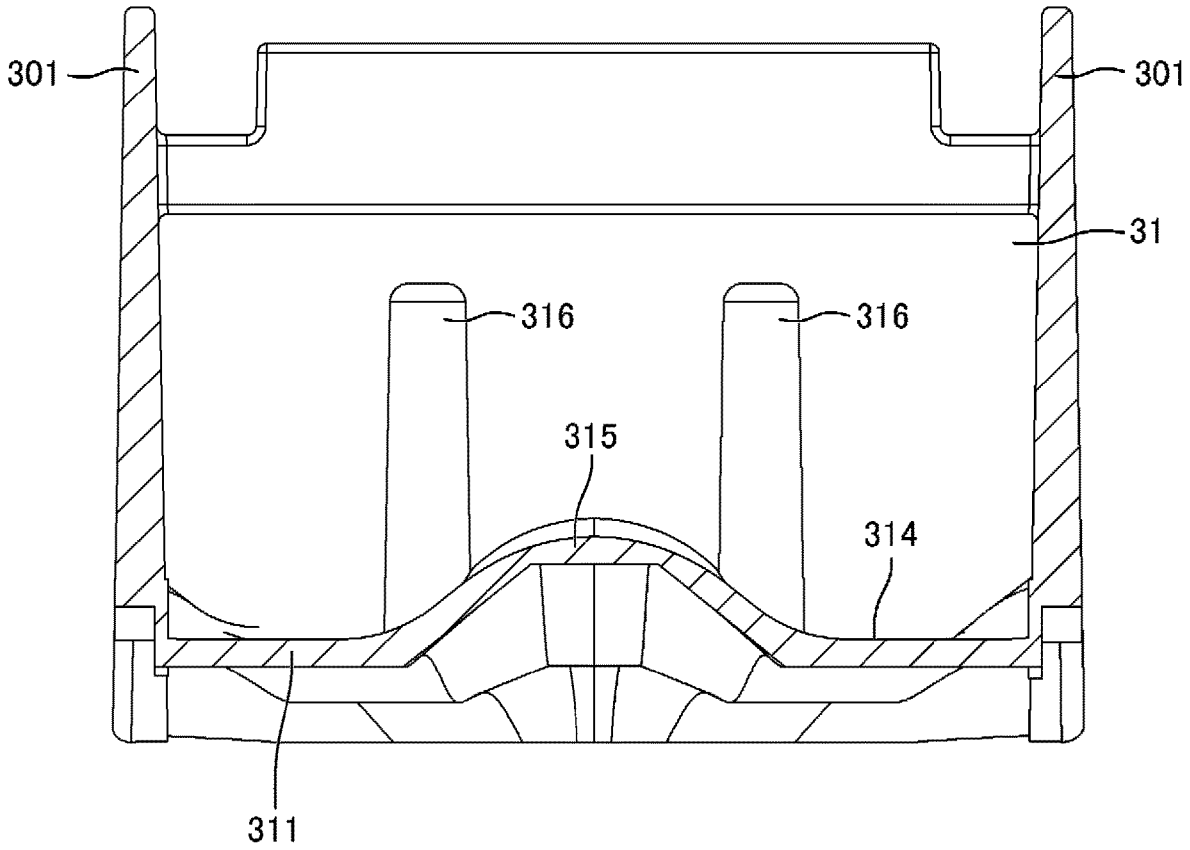
FIG. 9 is a cross-sectional view taken along line D-D in FIG. 5.
Figure 10:
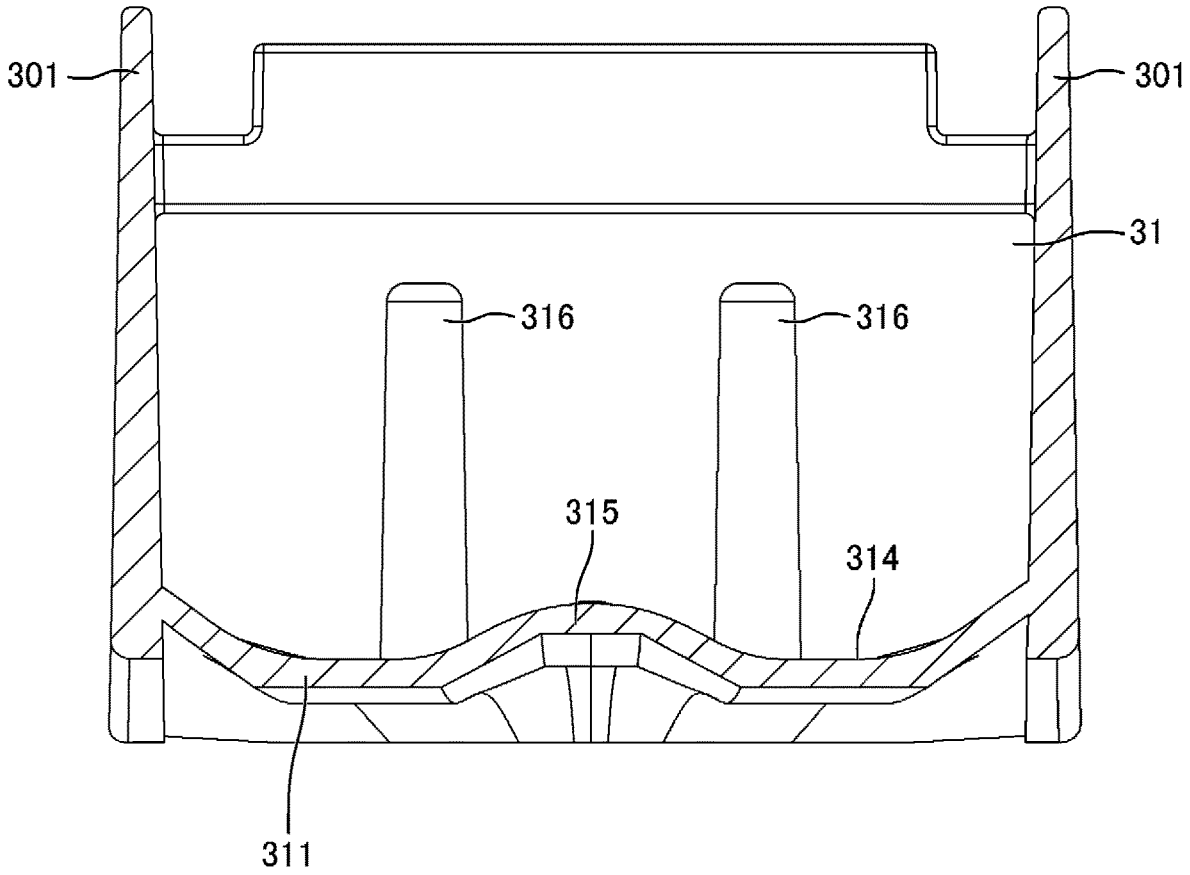
FIG. 10 is a cross-sectional view taken along line E-E in FIG. 5.
Figure 11:
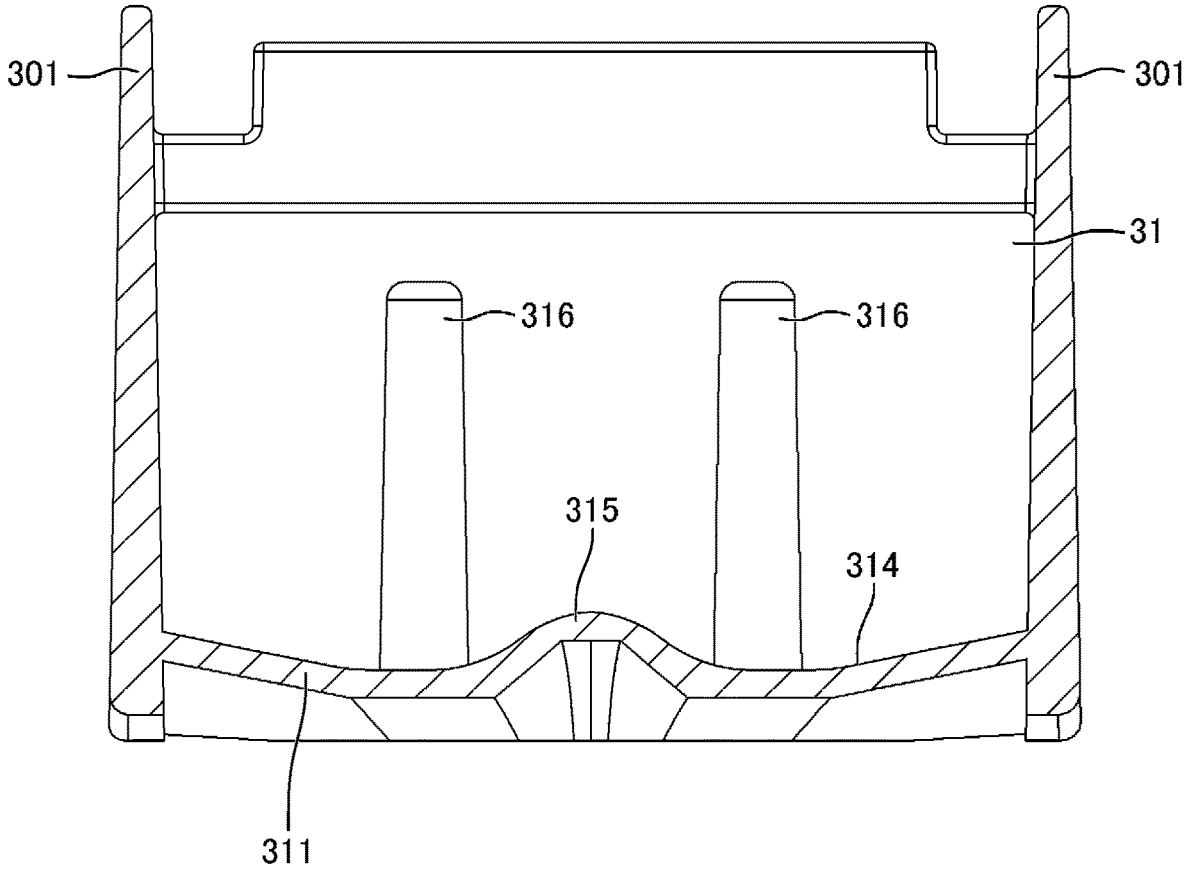
FIG. 11 is a cross-sectional view taken along line F-F in FIG. 5.

The first accommodation chamber 31 will be described in detail with reference to FIGS. 5 to 11. FIG. 5 is a plan view of the first accommodation chamber 31. FIG. 6 is a cross-sectional view taken along line A-A in FIG. 5. FIG. 7 is a cross-sectional view taken along line B-B in FIG. 5. FIG. 8 is a cross-sectional view taken along line C-C in FIG. 5. FIG. 9 is a cross-sectional view taken along line D-D in FIG. 5. FIG. 10 is a cross-sectional view taken along line E-E in FIG. 5. FIG. 11 is a cross-sectional view taken along line F-F in FIG. 5.

As illustrated in FIGS. 5 to 8, the first accommodation chamber 31 is open at the top and the rear and includes a first bottom portion 311 that receives the washing treatment agent (powder detergent). The first bottom portion 311 is formed in a plate shape. The first bottom portion 311 is formed such that a rear end portion 313 is lower than a front end portion 312. The front end portion 312 of the first bottom portion 311 is continuous with a lower end portion of the front wall 302. The first accommodation chamber 31 is open at the rear, and the rear end portion 313 of the first bottom portion 311 is not continuous with the rear wall 303. The first bottom portion 311 is formed in a wavy shape, and the height (position in the vertical direction) of the first bottom portion 311 increases and decreases from the front end portion 312 toward the rear end portion 313. That is, the first bottom portion 311 is formed so as to descend while waving from the front end portion 312 toward the rear end portion 313.

Specifically, the first bottom portion 311 includes a first upper surface 314 on which the powder detergent is placed. The first upper surface 314 is formed such that the front end portion 312 is located above the rear end portion 313. Further, the first upper surface 314 includes an inclined portion 315. In the present embodiment, the entire first upper surface 314 is the inclined portion 315.

The inclined portion 315 is formed such that a first gradient of the inclined portion 315 varies in the front-rear direction. The first gradient represents a ratio of distance in the vertical direction to a change in distance in the front-rear direction. In other words, the first gradient is a degree of inclination in the front-rear direction. The inclined portion 315 has different first gradients at different portions in the front-rear direction.

Specifically, the first gradient of the inclined portion 315 continuously varies, repeatedly increasing and decreasing in the front-rear direction. Furthermore, in the present embodiment, the first gradient of the inclined portion 315 varies such that an upward gradient and a downward gradient are repeated in the front-rear direction. For example, the polarity of the first gradient in the case of the downward gradient that descends from the front toward the rear is assumed to be positive. In this case, the first gradient of the inclined portion 315 varies such that the polarity of the first gradient repeatedly switches between positive and negative in the front-rear direction. That is, the inclined portion 315 undulates so as to repeat the pattern of protrusion and recess in the front-rear direction. In other words, the inclined portion 315 is formed in a wave shape in which the height of the inclined portion 315 repeatedly increases and decreases in the front-rear direction. In the present embodiment, the inclined portion 315 is formed such that a recessed portion and a protruding portion are alternately repeated twice in the front-rear direction.

As illustrated in FIGS. 9 to 11, the inclined portion 315 is formed such that a second gradient varies in the left-right direction. The second gradient represents a ratio of distance in the vertical direction to a change in distance in the left-right direction. In other words, the second gradient is a degree of inclination in the left-right direction. The inclined portion 315 has different second gradients at different portions in the left-right direction.

Specifically, the second gradient of the inclined portion 315 varies, repeatedly increasing and decreasing in the left-right direction. In the present embodiment, the inclined portion 315 is formed such that the central portion of the inclined portion 315 is the largest part thereof in the left-right direction. The largest part herein refers to a point at which the second gradient is substantially zero and changes from an upward gradient to a downward gradient in the left-right direction. In other words, the inclined portion 315 is formed such that the central portion thereof in the left-right direction has a mountain shape. Further, in the present embodiment, the second gradient of the inclined portion 315 partially varies such that an upward gradient and a downward gradient are repeated in the left-right direction. Specifically, at a portion of the inclined portion 315 rearward of the central portion in the front-rear direction (hereinafter also referred to as "rear portion"), the second gradient varies such that an upward gradient and a downward gradient are repeated. For example, the polarity of the second gradient in the case of a downward gradient that descends from the left to the right is assumed to be positive. In this case, in the rear portion of the inclined portion 315, the second gradient varies such that the polarity of the second gradient repeatedly switches between positive and negative in the left-right direction. Specifically, the rear portion of the inclined portion 315 undulates so as to repeat the pattern of recess and protrusion in the left-right direction. In other words, the rear portion of the inclined portion 315 is formed in a wave shape in which the height of the inclined portion 315 repeatedly increases and decreases in the left-right direction. In the present embodiment, the rear portion of the inclined portion 315 is formed such that a downward gradient and an upward gradient are repeated twice in the left-right direction.

Herein, a point at which the polarity of the second gradient changes in the left-right direction is referred to as a polarity change point. The polarity change point is, for example, a point at which the polarity of the second gradient changes from positive or negative to zero in the left-right direction or a point at which the polarity of the second gradient changes from zero to positive or negative in the left-right direction. That is, the polarity change point is a boundary between a portion where the second gradient is zero and a portion where the polarity of the second gradient is positive or negative. FIG. 5 schematically illustrates a polarity change line Lx connecting the polarity change points continuous in the front-rear direction. As described above, the second gradient of the inclined portion 315 varies so as to repeatedly increase and decrease in the left-right direction. Thus, the inclined portion 315 includes a plurality of the polarity change lines Lx. FIG. 5 illustrates five of the polarity change lines Lx. As described above, in the rear portion of the inclined portion 315, the second gradient varies such that the polarity of the second gradient repeatedly switches between positive and negative in the left-right direction. Thus, two of the five polarity change lines Lx located on both left and right sides are formed in the rear portion of the inclined portion 315. When distinguishing the five polarity change lines Lx from each other, the polarity change lines Lx are referred to as a first polarity change line L1, a second polarity change line L2, . . . , and a fifth polarity change line L5 in order from the left.

In addition, an interval between the plurality of polarity change points in the left-right direction, that is, an interval between the plurality of polarity change lines Lx is referred to as a polarity change interval. As illustrated in FIG. 5, the inclined portion 315 is formed such that the polarity change interval on the rear end portion 313 side is narrower than the polarity change interval on the front end portion 312 side. In the present embodiment, the inclined portion 315 is formed such that the polarity change interval becomes narrower toward the rear.

An average value of distances in the left-right direction between the central portion of the inclined portion 315 and the plurality of polarity change lines Lx (polarity change points) is referred to as an average deviation value. As illustrated in FIG. 5, the inclined portion 315 is formed such that the average deviation value on the rear end portion 313 side is smaller than the average deviation value on the front end portion 312 side. In other words, the inclined portion 315 is formed such that each polarity change line Lx approaches the central portion in the left-right direction toward the rear. Strictly speaking, the third polarity change line L3 is formed in the central portion in the left-right direction from the front end portion 312 to the rear end portion 313 of the inclined portion 315.

That is, the inclined portion 315 according to the present embodiment is formed such that the polarity change interval becomes narrower and each polarity change line Lx approaches the central portion in the left-right direction from the front toward the rear.

As illustrated in FIG. 5, the main body portion 3 includes a pair of column portions 316 formed on the first bottom portion 311 of the first accommodation chamber 31. Each of the pair of column portions 316 is formed in a cylindrical shape and is formed so as to protrude upward from the rear end portion 313 of the first bottom portion 311. The pair of column portions 316 are formed on both left and right sides of the central portion of the first bottom portion 311 in the left-right direction so as to interpose the central portion. More specifically, a left column portion 316 of the pair of column portions 316 is formed so as to be positioned between the first polarity change line L1 and the second polarity change line L2. A right column portion 316 of the pair of column portions 316 is formed so as to be positioned between the fourth polarity change line L4 and the fifth polarity change line L5.

Next, the second accommodation chamber 32 and the third accommodation chamber 33 will be described with reference to FIG. 4.

The second accommodation chamber 32 is open at the top and includes a second bottom portion 321 configured to receive a liquid detergent or a bleach as the washing treatment agent. A second cylindrical portion 322 is formed on the second bottom portion 321. The second cylindrical portion 322 is formed in a cylindrical shape and is formed so as to protrude upward from the upper surface of the second bottom portion 321. The second cylindrical portion 322 is open at an upper end portion and a lower end portion and is hollow in the vertical direction. The second cylindrical portion 322 is covered with a second cap 323.

The second cap 323 is formed in a cylindrical shape and has a closed upper end portion and an open lower end portion. The second cap 323 is provided covering the second cylindrical portion 322 from above. The second cap 323 is provided such that a space is formed between the second cap 323 and the outer peripheral surface and upper end portion of the second cylindrical portion 322. A second flange portion 324 is formed on the second cap 323.

The second flange portion 324 is formed so as to protrude from the outer peripheral surface of the second cap 323 in the radial direction of the second cap 323. The second flange portion 324 is formed such that its position in the vertical direction is slightly lower than the position of the upper end portion of the second cylindrical portion 322. The liquid washing treatment agent can be accommodated in the second accommodation chamber 32 up to a position lower than the second flange portion 324.

For example, it is assumed that a liquid detergent is accommodated as the liquid washing treatment agent in the second accommodation chamber 32. When water is supplied to the second accommodation chamber 32 from above, an aqueous solution in which the liquid detergent is dissolved in the water is produced. When the water level of the aqueous solution exceeds the upper end portion of the second cylindrical portion 322, the aqueous solution in the second accommodation chamber 32 is discharged downward of the second accommodation chamber 32 through the inside of the second cylindrical portion 322 by the siphon principle. As illustrated in FIG. 3, the bottom cover 5 is provided below the main body portion 3. The bottom cover 5 is provided covering the main body portion 3 from below. The bottom cover 5 includes a bottom plate portion 51 that opposes the lower surface of the main body portion 3 in the vertical direction. The bottom plate portion 51 is formed so as to be inclined downward from the rear toward the front. A front end portion of the bottom plate portion 51 is located above the opening of the washing machine tank 13. The aqueous solution discharged from the second accommodation chamber 32 is dispensed to the washing machine tank 13 along the bottom plate portion 51. Even when the liquid detergent is not accommodated in the second accommodation chamber 32, water supplied to the second accommodation chamber 32 is discharged from the second accommodation chamber 32 by the siphon principle.

The third accommodation chamber 33 is open at the top and has a third bottom portion 331 configured to receive a liquid fabric softener as the washing treatment agent. The third accommodation chamber 33 has the same configuration as the second accommodation chamber 32 and includes a third cylindrical portion 332, a third cap 333, and a third flange portion 334. Since the third cylindrical portion 332, the third cap 333, and the third flange portion 334 have the same configurations as the second cylindrical portion 322, the second cap 323, and the second flange portion 324 of the second accommodation chamber 32, respectively, detailed description thereof will be omitted.

In a manner similar to the second accommodation chamber 32, an aqueous solution of water and the fabric softener accommodated in the third accommodation chamber 33 is also discharged downward of the third accommodation chamber 33 by the siphon principle and dispensed to the washing machine tank 13.

Figure 12:
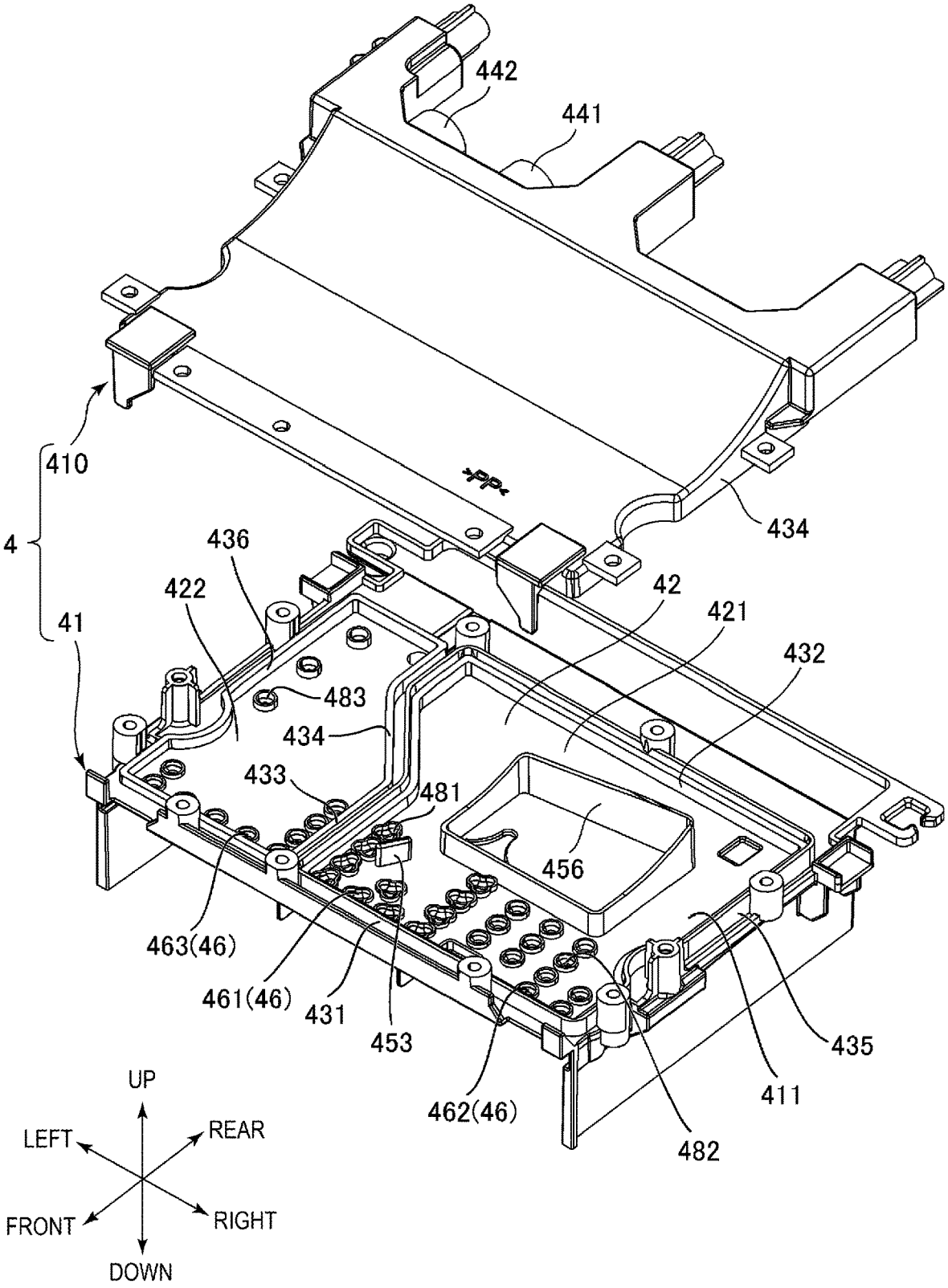
FIG. 12 is a first exploded perspective view of a water supply portion of the case.
Figure 13:
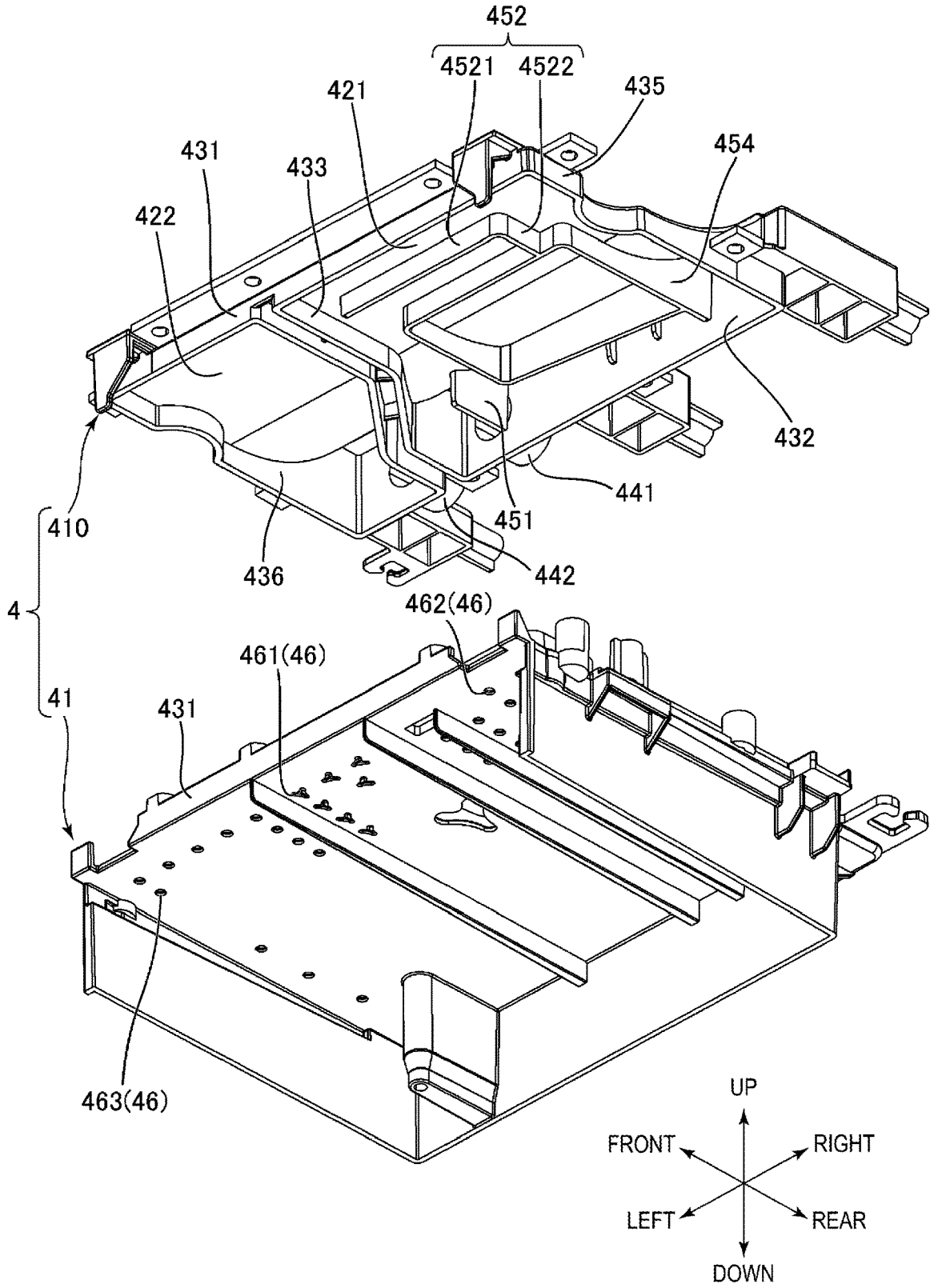
FIG. 13 is a second exploded perspective view of the water supply portion.

Next, the water supply portion 4 will be described with reference to FIGS. 12 and 16.

The water supply portion 4 is configured to supply water to each accommodation chamber 30 of the main body portion 3 from above. The water supply portion 4 according to the present embodiment has a ceiling portion 41 that is open at the top, and an upper cover 410 that is open at the bottom. The ceiling portion 41 is provided covering the main body portion 3 from above, and functions as a ceiling of each accommodation chamber 30 (see FIG. 3). The ceiling portion 41 and the upper cover 410 are configured to be combined with each other in the vertical direction. The ceiling portion 41 and the upper cover 410 are combined to form a water supply chamber 42 configured to temporarily store water to be supplied to each accommodation chamber 30. In the present embodiment, the water supply chamber 42 is divided into a first water supply chamber 421 and a second water supply chamber 422 by a partition wall 433. The partition wall 433 is formed so as to connect a front wall 431 and a rear wall 432 of the water supply chamber 42. The partition wall 433 includes an inclined wall 434 that is inclined in the left-right direction relative to the front-rear direction such that a front end portion of the inclined wall 434 is located to the right of a rear end portion of the inclined wall 434. The first water supply chamber 421 and the second water supply chamber 422 are formed side by side in the left-right direction by the partition wall 433.

The first water supply chamber 421 is located above the first accommodation chamber 31 and the second accommodation chamber 32. The upper cover 410 includes a first inflow port 441. The first inflow port 441 is formed in a cylindrical shape. The first inflow port 441 protrudes rearward from a right side portion of the partition wall 433 in the rear wall 432 of the water supply chamber 42. A first nozzle is connected to the first inflow port 441. Water flows into the first water supply chamber 421 from the first nozzle through the first inflow port 441. The water that has flowed into the first water supply chamber 421 is supplied to the first accommodation chamber 31 and the second accommodation chamber 32 from above the first accommodation chamber 31 and the second accommodation chamber 32.

The first water supply chamber 421 includes a first dividing wall 451, a second dividing wall 452, a third dividing wall 453, a fourth dividing wall 454, a first peripheral wall 455, and a second peripheral wall 456. These walls control the flow of water.

The first dividing wall 451 is formed in a plate shape in which the left-right direction is a thickness direction. The first dividing wall 451 is formed so as to protrude downward from the upper cover 410. The first dividing wall 451 is formed on the right side of the first inflow port 441 of the upper cover 410 such that the first inflow port 441 is located between the first dividing wall 451 the partition wall 433. Further, the first dividing wall 451 is formed so as to be separated more rearward from the front portion than the inclined wall 434 of the partition wall 433. The first dividing wall 451 and the partition wall 433 form a flow path therebetween through which the water that has flowed into the first water supply chamber 421 via the first inflow port 441 flows.

The second dividing wall 452 includes a first plate portion 4521 and a second plate portion 4522 formed in a plate shape. The first plate portion 4521 and the second plate portion 4522 are formed in an L-shape in plan view. The second dividing wall 452 is formed so as to protrude downward from the upper cover 410. A gap is formed between a lower end of the second dividing wall 452 and the ceiling portion 41.

The first plate portion 4521 is formed in a rectangular plate shape in which the front-rear direction is the thickness direction and the left-right direction is the longitudinal direction. The first plate portion 4521 is formed along the left-right direction from above the first accommodation chamber 31 to above the second accommodation chamber 32. The first plate portion 4521 is formed at a position separated rearward from the front wall 431 of the first water supply chamber 421, separated rightward from the partition wall 433, and separated leftward from a right wall 435 of the first water supply chamber 421. The first plate portion 4521 is formed such that a gap between the first plate portion 4521, the partition wall 433, the front wall 431 of the first water supply chamber 421, and the right wall 435 of the first water supply chamber 421 serves as a water flow path.

The second plate portion 4522 is formed in a plate shape in which the left-right direction is a thickness direction. The second plate portion 4522 is formed continuous with the right end portion of the first plate portion 4521.

The first peripheral wall 455 is formed in a rectangular frame shape. The first peripheral wall 455 is formed behind the second plate portion 4522, continuous with a rear end portion of the second plate portion 4522. The first peripheral wall 455 is located above the first accommodation chamber 31 and above the second accommodation chamber 32. The first peripheral wall 455 is formed at a position separated rightward from the partition wall 433 and the first dividing wall 451, separated leftward from the right wall 435 of the first water supply chamber 421, and separated forward from the rear wall 432 of the first water supply chamber 421. The first peripheral wall 455 is formed such that a gap between the first peripheral wall 455, the partition wall 433, the first dividing wall 451, the first plate portion 4521 of the second dividing wall 452, the right wall 435 of the first water supply chamber 421, and the rear wall 432 of the first water supply chamber 421 serves as a water flow path. The first peripheral wall 455 is formed so as to protrude downward from the upper cover 410. A gap is formed between the lower end of the first peripheral wall 455 and the ceiling portion 41.

The second peripheral wall 456 is formed in a rectangular frame shape. The second peripheral wall 456 is formed inward of the first peripheral wall 455, extending along the first peripheral wall 455. The second peripheral wall 456 is formed with a gap between the second peripheral wall 456 and the first peripheral wall 455. The second peripheral wall 456 is formed so as to protrude upward from the ceiling portion 41. A gap is formed between the upper end of the second peripheral wall 456 and the upper cover 410. Further, the second peripheral wall 456 is formed such that the front wall is lower than the rear wall.

The third dividing wall 453 is formed in a plate shape, along the right rear direction from the left end portion of the first plate portion 4521 of the second dividing wall 452. A gap is formed between the right rear end portion of the third dividing wall 453 and the first peripheral wall 455. The third dividing wall 453 is formed such that a gap between the third dividing wall 453 and the first peripheral wall 455 serves as a water flow path. The third dividing wall 453 is formed so as to protrude upward from the ceiling portion 41.

The fourth dividing wall 454 is formed in a plate shape in which the left-right direction is a thickness direction. The fourth dividing wall 454 is formed so as to protrude rearward from the right wall of the first peripheral wall 455. A gap is formed between the fourth dividing wall 454 and the rear wall 432 of the first water supply chamber 421. The fourth dividing wall 454 is formed such that a gap between the fourth dividing wall 454 and the rear wall 432 of the first water supply chamber 421 serves as a water flow path. The fourth dividing wall 454 is formed so as to protrude downward from the upper cover 410.

Figure 14:
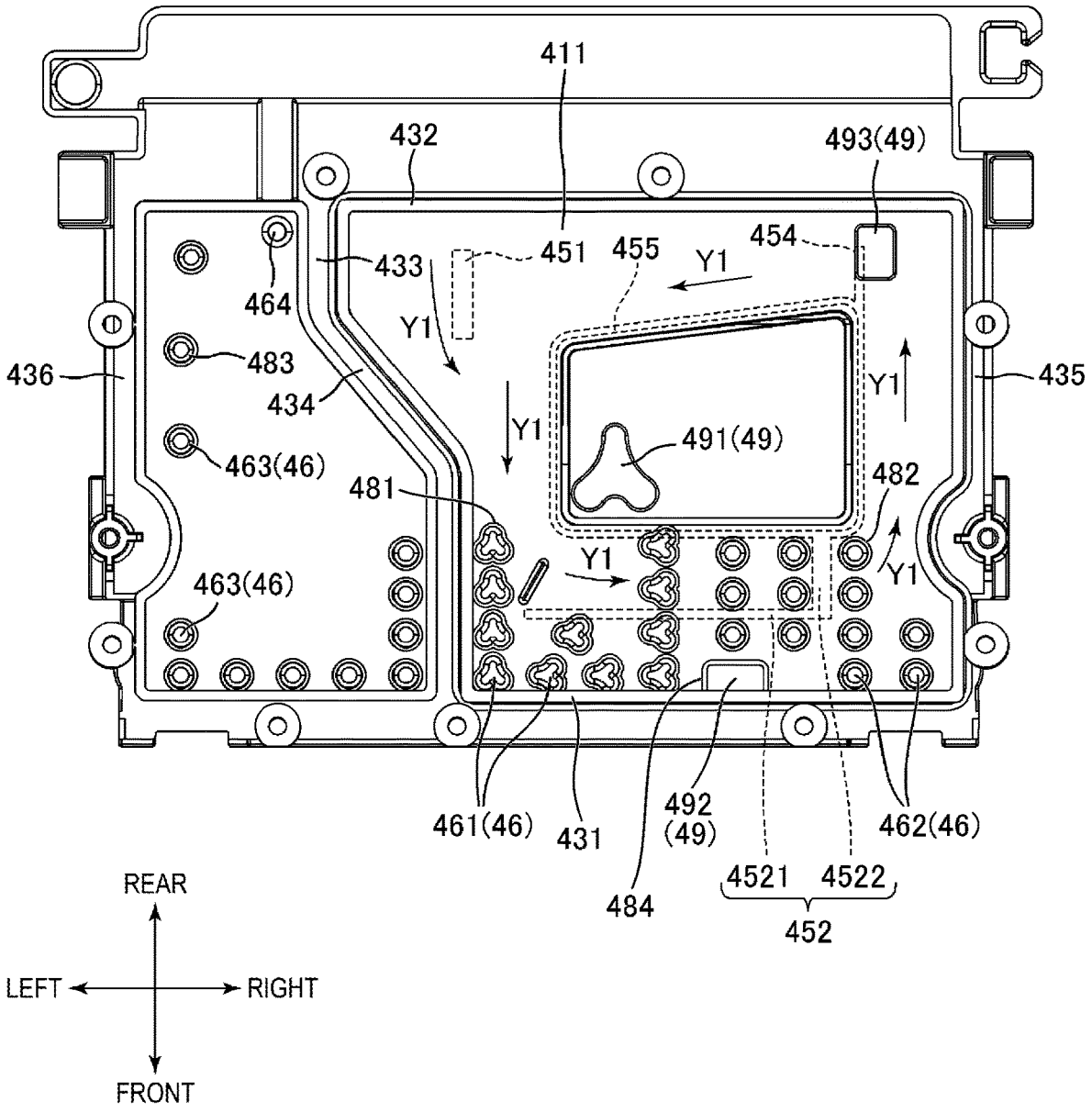
FIG. 14 is a plan view of a ceiling portion of the water supply portion.

In the first water supply chamber 421, the first dividing wall 451, the second dividing wall 452, the third dividing wall 453, the fourth dividing wall 454, the first peripheral wall 455, and the second peripheral wall 456 cause water that has been supplied via the first inflow port 441 to flow counterclockwise about the first peripheral wall 455 (see the arrow Y1 in FIG. 14). When the water level exceeds the height of the second peripheral wall 456, the water flows into the second peripheral wall 456.

The second water supply chamber 422 is located above the third accommodation chamber 33. The upper cover 410 includes a second inflow port 442. The second inflow port 442 is formed in a cylindrical shape. The second inflow port 442 protrudes rearward from a left portion of the partition wall 433 in the rear wall 432 of the water supply chamber 42. The second inflow port 442 and the first inflow port 441 are formed side by side in the left-right direction with the partition wall 433 interposed therebetween. A second nozzle is connected to the second inflow port 442. Water flows into the second water supply chamber 422 from the second nozzle through the second inflow port 442. The water that has flowed into the second water supply chamber 422 is supplied to the third accommodation chamber 33 from above the third accommodation chamber 33.

The ceiling portion 41 also functions as a bottom of the first water supply chamber 421 and the second water supply chamber 422 and includes an upper surface 411 where water to be supplied to the main body portion 3 flows. A plurality of water supply holes 46 through which the water to be supplied to the main body portion 3 passes in the vertical direction are formed in the ceiling portion 41. Water is supplied to the main body portion 3 from above through the plurality of water supply holes 46.

The plurality of water supply holes 46 include a plurality of first water supply holes 461, a plurality of second water supply holes 462, and a plurality of third water supply holes 463. In the ceiling portion 41, the plurality of first water supply holes 461 are located above the first accommodation chamber 31. In the ceiling portion 41, the plurality of second water supply holes 462 are located above the second accommodation chamber 32. In the ceiling portion 41, the plurality of third water supply holes 463 are located above the third accommodation chamber 33.

In the present embodiment, eleven first water supply holes 461 are formed in the ceiling portion 41 as the plurality of first water supply holes 461. Four first water supply holes 461 of the eleven first water supply holes 461 are formed so as to be arranged along the partition wall 433 from a corner portion where the partition wall 433 and the front wall 431 of the first water supply chamber 421 are continuous. Two first water supply holes 461 of the four first water supply holes 461 are formed more rearward of the first plate portion 4521 of the second dividing wall 452. In addition, three first water supply holes 461 of the eleven first water supply holes 461 are formed so as to be arranged along the front wall 431 of the first water supply chamber 421 together with one first water supply hole 461 provided at the corner portion where the partition wall 433 and the front wall 431 of the first water supply chamber 421 are continuous. In addition, two first water supply holes 461 of the eleven first water supply holes 461 are formed so as to be arranged along the first plate portion 4521 between the front wall 431 of the first water supply chamber 421 and the first plate portion 4521 of the second dividing wall 452. In addition, two first water supply holes 461 of the eleven first water supply holes 461 are formed so as to be arranged in the front-rear direction between the first plate portion 4521 of the second dividing wall 452 and the first peripheral wall 455. The two first water supply holes 461 are formed such that the two first water supply holes 461 and two of five first water supply holes 461 formed between the front wall 431 of the first water supply chamber 421 and the first plate portion 4521 of the second dividing wall 452 are arranged in the front-rear direction with the first plate portion 4521 interposed therebetween.

Further, in the present embodiment, twelve second water supply holes 462 are formed in the ceiling portion 41 as the plurality of second water supply holes 462. Four second water supply holes 462 of the twelve second water supply holes 462 are formed between the first plate portion 4521 of the second dividing wall 452 and the first peripheral wall 455, arranged in the front-rear direction and the left-right direction along the first plate portion 4521 and the first peripheral wall 455. In addition, five second water supply holes 462 of the twelve second water supply holes 462 are formed between the second dividing wall 452 and the front wall 431 and right wall 435 of the first water supply chamber 421, arranged in an L-shape along the first plate portion 4521 and the second plate portion 4522 of the second dividing wall 452. Three second water supply holes 462 of the twelve second water supply holes 462 are formed arranged in an L-shape along the front wall 431 and the right wall 435 of the first water supply chamber 421.

Further, in the present embodiment, twelve third water supply holes 463 are formed in the ceiling portion 41 as the plurality of third water supply holes 463. Nine third water supply holes 463 of the twelve third water supply holes 463 are formed arranged in a U-shape along a left wall 436 and the front wall 431 of the second water supply chamber 422 and the partition wall 433. In addition, three third water supply holes 463 of the twelve third water supply holes 463 are formed arranged along the left wall 436 of the second water supply chamber 422 from a corner portion where the left wall 436 and the rear wall 432 of the second water supply chamber 422 are continuous. In the present embodiment, a drain hole 464 is formed in the ceiling portion 41. The drain hole 464 is formed at a corner portion where the rear wall 303 of the second water supply chamber 422 and the partition wall 433 are continuous. The drain hole 464 is formed so as to extend through to the outside of the third accommodation chamber 33 and be continuous with the bottom cover 5 provided below the main body portion 3.

Further, in the ceiling portion 41, a plurality of large water supply holes 49 through which water to be supplied to the main body portion 3 passes in the vertical direction are formed, in addition to the plurality of water supply holes 46. The opening area of each large water supply hole 49 is larger than that of each water supply hole 46. Water is supplied to the main body portion 3 from above through the plurality of large water supply holes 49 in addition to the plurality of water supply holes 46.

The plurality of large water supply holes 49 include a first large water supply hole 491, a second large water supply hole 492, and a third large water supply hole 493.

In the ceiling portion 41, the first large water supply hole 491 is located above the first accommodation chamber 31. Inside the second peripheral wall 456, the first large water supply hole 491 is formed at a corner portion where the left wall of the second peripheral wall 456 and the front wall are continuous.

In the ceiling portion 41, the second large water supply hole 492 and the third large water supply hole 493 are located above the second accommodation chamber 32. The second large water supply hole 492 is formed between the front wall 431 of the first water supply chamber 421 and the first plate portion 4521 of the second dividing wall 452, extending along the front wall 431 of the first water supply chamber 421. The third large water supply hole 493 is formed on the right side of the fourth dividing wall 454.

Next, the opening shape of each of the plurality of water supply holes 46 will be described.

In the present embodiment, the opening shape of each of the plurality of first water supply holes 461 is different from the opening shape of each of the plurality of second water supply holes 462 and the plurality of third water supply holes 463. The opening shape of each of the plurality of second water supply holes 462 and the plurality of third water supply holes 463 is circular. The plurality of first water supply holes 461, the plurality of second water supply holes 462, and the plurality of third water supply holes 463 have the same opening area.

Figure 15:
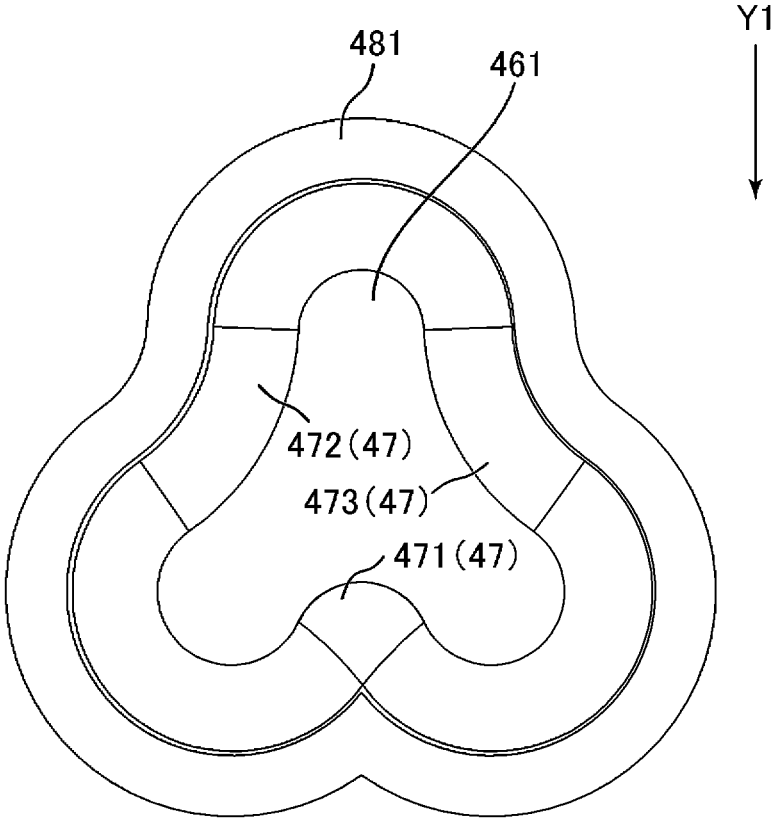
FIG. 15 is an enlarged plan view of a first water supply hole of the water supply portion.
Figure 16:
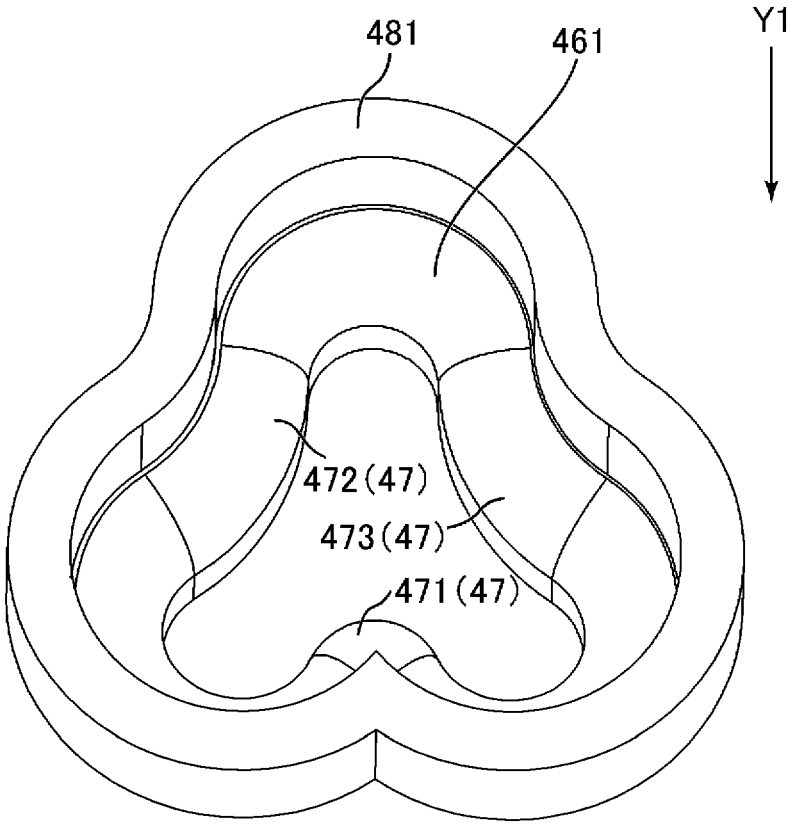
FIG. 16 is an enlarged perspective view of the first water supply hole.

On the other hand, as illustrated in FIGS. 15 and 16, the opening shape of each of the plurality of first water supply holes 461 is a recessed shape. The term "recessed shape" in the present embodiment refers to a shape (recessed figure) having at least one recessed portion 47 recessed toward the inside of the opening (first water supply hole 461). In other words, the recessed shape is a shape other than a protruding shape (protruding figure), and can include a region outside the opening on a straight line connecting any two points in the opening (first water supply hole 461). For example, in the first water supply hole 461, a straight line connecting two points on either side of the recessed portion 47 in a direction orthogonal to a direction in which the recessed portion 47 is recessed crosses the recessed portion 47. Further, when the recessed shape is, for example, a polygon, the recessed shape is a shape having an interior angle of 180° or more and less than 360°.

In the present embodiment, the opening shape of the first water supply hole 461 is a recessed shape including a plurality of the recessed portions 47. The plurality of recessed portions 47 are a first recessed portion 471, a second recessed portion 472, and a third recessed portion 473, each recessed in mutually different directions. In the first water supply hole 461, the recess dimension of the first recessed portion 471 is larger than the recess dimension of each of the second recessed portion 472 and the third recessed portion 473. The term "recess dimension" in the present embodiment refers to a dimension from a proximal end to a distal end of each recessed portion 47 in a direction in which the recessed portion 47 is recessed. Herein, a direction in which the first recessed portion 471 is recessed is referred to as a first direction, and a direction intersecting the first direction is referred to as a second direction. The second recessed portion 472 is formed on one side in the second direction with respect to the first recessed portion 471, and the third recessed portion 473 is formed on another side in the second direction with respect to the first recessed portion 471. In the present embodiment, the first recessed portion 471, the second recessed portion 472, and the third recessed portion 473 are provided at intervals of approximately 120 degrees at the center of the first water supply hole 461. Further, the opening shape of the first water supply hole 461 is a line-symmetric shape with respect to a straight line along the first direction extending through the center of the first water supply hole 461.

The first water supply hole 461 is constricted by the first recessed portion 471, the second recessed portion 472, and the third recessed portion 473. The term "constricted" as used in the present embodiment means that the width of the opening is partially narrowed, and either side of the narrowed portion is widened. In the present embodiment, the first water supply hole 461 is constricted at a portion where the first recessed portion 471 and the second recessed portion 472 are close to each other and at a portion where the first recessed portion 471 and the third recessed portion 473 are close to each other.

In the present embodiment, the first recessed portion 471, the second recessed portion 472, and the third recessed portion 473 are formed by a curved line. In other words, the edges of the first recessed portion 471, the second recessed portion 472, and the third recessed portion 473 are curved. Furthermore, in the present embodiment, the opening peripheral edge of the first water supply hole 461 including the first recessed portion 471, the second recessed portion 472, and the third recessed portion 473 is formed by a curved line.

Each of the plurality of first water supply holes 461 is formed such that the first recessed portion 471, the second recessed portion 472, and the third recessed portion 473 are recessed in a direction different from a direction Y1 of water flowing on the upper surface 411 of the ceiling portion 41. Further, each of the plurality of first water supply holes 461 is formed such that the first recessed portion 471 is recessed in the upstream direction of water flowing on the upper surface 411 of the ceiling portion 41. As described above, in the first water supply chamber 421, water flows counter-clockwise about the first peripheral wall 455. As illustrated in FIG. 14, in the present embodiment, four first water supply holes 461 of the eleven first water supply holes 461 along the partition wall 433 are formed such that the first recessed portion 471 is recessed rearward, and the remaining seven first water supply holes 461 are formed such that the first recessed portion 471 is recessed leftward.

A rib 481 is formed on an outer peripheral edge of each of the plurality of first water supply holes 461. The rib 481 is formed upward from the outer peripheral edge of the first water supply hole 461. Although the rib 481 is formed on the upper surface 411 of the ceiling portion 41 in the present embodiment, the rib may be formed on a lower surface of the ceiling portion 41 so as to extend downward from the outer peripheral edge of the first water supply hole 461. In a manner similar to the first water supply hole 461, a rib 482 is formed on an outer peripheral edge of each of the second water supply holes 462, and a rib 483 is formed on an outer peripheral edge of each of the third water supply holes 463 (see FIG. 12). The rib 482 is formed so as to protrude upward from the outer peripheral edge of the second water supply hole 462. The rib 483 is formed so as to protrude upward from the outer peripheral edge of the third water supply hole 463.

As illustrated in FIG. 16, the corner of the outer peripheral edge of each of the plurality of first water supply holes 461 is cut off. In the present embodiment, the outer peripheral edge of the first water supply hole 461 is subjected to rounding as the process of cutting off the corner and curved. Note that the outer peripheral edge of the first water supply hole 461 may be subjected to chamfering as the process of cutting off the corner. In a manner similar to the first water supply hole 461, the corner of the outer peripheral edge of each of the second water supply hole 462 and the third water supply hole 463 is cut off. In the present embodiment, the outer peripheral edge of each of the second water supply hole 462 and the third water supply hole 463 is subjected to rounding as the process of cutting off the corner and curved. Note that the outer peripheral edge of each of the second water supply hole 462 and the third water supply hole 463 may be subjected to chamfering as the process of cutting off the corner.

Next, an opening shape of each of the plurality of large water supply holes 49 will be described.

As illustrated in FIG. 14, the opening shape of the first large water supply hole 491 is the same as that of the first water supply hole 461, and the opening area of the first large water supply hole 491 is larger than that of the first water supply hole 461. The corner of the outer peripheral edge of the first large water supply hole 491 is cut off. In the present embodiment, the outer peripheral edge of the first large water supply hole 491 is subjected to rounding as the process of cutting off the corner and curved.

The opening shape of the second large water supply hole 492 is a rectangular shape in which the left-right direction is a longitudinal direction. Further, a rib 484 is formed on an outer peripheral edge of the second large water supply hole 492. The rib 484 is formed so as to protrude upward from the outer peripheral edge of the second large water supply hole 492.

The opening shape of the third large water supply hole 493 is a rectangular shape in which the front-rear direction is a longitudinal direction. The corner of the outer peripheral edge of the third large water supply hole 493 is cut off. In the present embodiment, the outer peripheral edge of the third large water supply hole 493 is subjected to rounding as the process of cutting off the corner. Note that the outer peripheral edge of the third large water supply hole 493 may be subjected to chamfering as the process of cutting off the corner.

Next, an operation of supplying water from the water supply portion 4 to the main body portion 3 in the case 2 according to the present embodiment will be described. Here, a case where a powder detergent is accommodated in the first accommodation chamber 31 and water is supplied from the first water supply chamber 421 to the first accommodation chamber 31 will be described.

As described above, water that has flowed into the first water supply chamber 421 through the first inflow port 441 flows counterclockwise about the first peripheral wall 455. The plurality of first water supply holes 461 are formed around the first peripheral wall 455 in a portion located above the first accommodation chamber 31. Thus, some of the water flowing on the upper surface 411 of the ceiling portion 41 flows down to the first accommodation chamber 31 through the plurality of first water supply holes 461.

Here, as illustrated in FIG. 15, the opening shape of each of the first water supply holes 461 is a recessed shape including the three recessed portions 47 (the first recessed portion 471, the second recessed portion 472, and the third recessed portion 473) and is constricted. In other words, the opening shape of the first water supply hole 461 is a shape in which a portion having a large opening area and a portion having a small opening area are continuous.

In the portion having a large opening area, the length of a wet edge is short with respect to the opening area, and the viscous resistance of the wall surface is small. Therefore, the water easily flows. On the other hand, in the portion having a small opening area, the length of a wet edge is long with respect to the opening area, and the viscous resistance of the wall surface is large. Therefore, the water does not easily flow. Thus, the water vigorously flows from the portion having a large opening area before the water from the portion having a small opening area. In other words, the water flows from the portion having a small opening area slightly after the water from the portion having a large opening area. Thus, the surface of the water flowing down from the first water supply hole 461 has a nonuniform pressure. Specifically, the pressure at the portion having a small opening area is lower than the pressure at the portion having a large opening area. Accordingly, when the water flows down from the first water supply hole 461, air is sucked in from the portion having a small opening area and mixed into the water. Thus, when the water flows down from the first water supply hole 461, the water is interrupted by the sucked-in air and turns into a plurality of water droplets due to the surface tension.

In this way, the water flowing down from the first water supply hole 461 turns into the plurality of water droplets and is supplied to the first accommodation chamber 31. As a result, the plurality of water droplets sequentially collide with the powder detergent accommodated in the first accommodation chamber 31. Additionally, the plurality of water droplets are deformed by colliding with the powder detergent. Thus, since the plurality of water droplets collide with the powder detergent, the powder detergent can be subjected to a larger collision energy, as compared with a case where a stream of water, which is a continuous flow of water, collides with the powder detergent. As a result, a lump of the powder detergent is broken down and easily dissolved in the water. This configuration can minimize undissolved residue of the powder detergent in the case 2.

Furthermore, since the opening shape of the first water supply hole 461 is a recessed shape, the water easily flows down through the first water supply hole 461 as compared with a case where the opening shape is circular. This improves the water supply efficiency from the first water supply chamber 421 to the first accommodation chamber 31, and thus increases the amount of water supplied to the first accommodation chamber 31. As a result, it is possible to further minimize undissolved residue of the powder detergent in the case 2.

As described above, in the present embodiment, for example, even when the water pressure of tap water is low and the amount of water per unit time supplied to the first water supply chamber 421 is small, the powder detergent in the first accommodation chamber 31 can be efficiently dissolved, thus minimizing undissolved residue of the powder detergent in the case 2.

The plurality of first water supply holes 461 are formed along the wall of the first accommodation chamber 31. This minimizes residual powder detergent at or near the wall of the first accommodation chamber 31.

The first recessed portion 471 of each of the plurality of first water supply holes 461 is formed so as to be recessed in the upstream direction of the water flowing on the upper surface 411 of the ceiling portion 41 (see the arrow Y1 in FIG. 14). Due to the viscous resistance of the wall surface of the first water supply hole 461, surface tension, and the like, the water flowing down from the first water supply hole 461 is directed in a direction opposite to the direction in which the recessed portion 47 is recessed. Thus, the direction of the water flowing down from the first water supply hole 461 can be corrected so as to be directed directly downward against the direction of the water flowing on the upper surface 411. Furthermore, in the present embodiment, the first recessed portion 471 has the largest recess dimension among the plurality of recessed portions 47. With this configuration, the direction of the water flowing down from the first water supply hole 461 is more easily directed directly downward, and the amount of the powder detergent that is not in contact with water can be reduced. Thus, undissolved residue of the powder detergent in the case 2 can be further minimized.

The rib 481 is formed on the outer peripheral edge of the first water supply hole 461. The rib 481 weakens the flow of water above the first water supply hole 461. As a result, the direction of the water flowing down from the first water supply hole 461 is more easily directed directly downward, and the amount of the powder detergent that is not in contact with water can be reduced. Thus, undissolved residue of the powder detergent in the case 2 can be further minimized.

The opening peripheral edge of the first water supply hole 461 is formed by a curved line. With this configuration, the water flowing down from the first water supply hole 461 easily becomes a plurality of water droplets, which can minimize undissolved residue of the powder detergent in the case 2. Note that at least a part of the opening peripheral edge of the first water supply hole 461 may be formed of straight line.

The corner of the outer peripheral edge of the first water supply hole 461 is cut off. Accordingly, the water easily flows into the first water supply hole 461, which can improve the water supply efficiency to the first accommodation chamber 31.

In addition to the plurality of first water supply holes 461, the plurality of second water supply holes 462, the second large water supply hole 492, and the third large water supply hole 493 are formed outside the first peripheral wall 455 of the first water supply chamber 421. Thus, the water flowing around the first peripheral wall 455 flows down to the second accommodation chamber 32 through the plurality of second water supply holes 462, the second large water supply hole 492, and the third large water supply hole 493, in addition to the first accommodation chamber 31. That is, the water that has flowed into the first water supply chamber 421 is supplied to both the first accommodation chamber 31 and the second accommodation chamber 32.

When the amount of water flowing into the first water supply chamber 421 is large and the water level of the water flowing around the first peripheral wall 455 exceeds the height of the second peripheral wall 456, the water flows to the inside of the second peripheral wall 456. The first large water supply hole 491 is formed inside the second peripheral wall 456.

The first large water supply hole 491 is formed above the first accommodation chamber 31. Thus, the water that has flowed to the inside of the second peripheral wall 456 flows down to the first accommodation chamber 31 through the first large water supply hole 491. The opening shape of the first large water supply hole 491 is the same as the opening shape of the first water supply hole 461.

Thus, in a manner similar to the first water supply hole 461, the water flowing down from the first large water supply hole 491 becomes a plurality of water droplets and is supplied to the first accommodation chamber 31. As a result, a lump of the powder detergent is broken down and easily dissolved in the water. This configuration can minimize undissolved residue of the powder detergent in the case 2. In addition, since the opening shape of the first large water supply hole 491 is a recessed shape, the water easily flows down through the first large water supply hole 491 as compared with a case where the opening shape is circular.

Next, a flow of water supplied from the first water supply chamber 421 to the first accommodation chamber 31 will be described.

As described above, the water is supplied to the first accommodation chamber 31 so as to flow down from the first water supply chamber 421 located above the first accommodation chamber 31. The first bottom portion 311 of the first accommodation chamber 31 is formed such that the front end portion 312 of the first upper surface 314 is located above the rear end portion 313. Thus, the water supplied to the first accommodation chamber 31 flows rearward along the first upper surface 314. The first accommodation chamber 31 is open at the rear, and the water that has flowed rearward along the first upper surface 314 flows down through the opening. The water that has flowed down from the first accommodation chamber 31 flows forward along the bottom plate portion 51 of the bottom cover 5 and is dispensed to the washing machine tank 13.

Here, as illustrated in FIGS. 5 to 11, in the present embodiment, the entire first upper surface 314 of the first accommodation chamber 31 is the inclined portion 315, and the first gradient in the front-rear direction continuously varies so as to repeatedly increase and decrease. That is, the inclined portion 315 is formed in a wavy shape in which the height repeatedly increases and decreases in the front-rear direction. Thus, the inclined portion 315 includes a portion having a large gradient in the front-rear direction (steep gradient portion) as compared with a configuration in which the gradient in the front-rear direction is constant. Thus, the flow velocity is increased when the water flows on the steep gradient portion, which can minimize residual powder detergent accommodated in the first accommodation chamber 31. In addition, since the first gradient continuously varies, the flow of water can be made gentle, which can further minimize residual powder detergent in the first accommodation chamber 31.

Furthermore, in the present embodiment, the second gradient of the inclined portion 315 in the left-right direction continuously varies so as to repeatedly increase and decrease. That is, the inclined portion 315 is formed in a wavy shape in which the height repeatedly increases and decreases in the left-right direction. Thus, in the present embodiment, the water flows not only in the front-rear direction but also in the left-right direction. Accordingly, the water that has flowed down from the first water supply chamber 421 flows so as to spread in the front-rear direction and the left-right direction, which can minimize residual powder detergent in the first accommodation chamber 31. Further, repeating the increase and decrease of the second gradient can increase the flow velocity of the water in the left-right direction, which can further minimize residual powder detergent in the first accommodation chamber 31.

In the present embodiment, both the first gradient in the front-rear direction and the second gradient in the left-right direction vary. Thus, at the rear end portion 313, which is the outlet of the first accommodation chamber 31, the water is likely to have different flow velocities at different portions in the left-right direction. This reduces the viscous resistance at the rear end portion 313 of the first accommodation chamber 31 and facilitates water flowing out from the first accommodation chamber 31. This increases the collision energy when the water flowing out of the first accommodation chamber 31 collides with the bottom cover 5 and facilitates dissolving of the powder detergent in the water.

The inclined portion 315 is formed such that the polarity change interval in the left-right direction on the rear end portion 313 side is narrower than the polarity change interval on the front end portion 312 side. That is, in the inclined portion 315 according to the present embodiment, the interval between the valleys in the left-right direction becomes narrower toward the rear end portion 313. Accordingly, in the inclined portion 315, the water flow path becomes narrower toward the rear end portion 313 serving as the downstream side, which can increase the flow velocity of the water. Thus, it is possible to further minimize residual powder detergent in the first accommodation chamber 31. Further, the inclined portion 315 according to the present embodiment is formed such that the average deviation value on the rear end portion 313 side is smaller than the average deviation value on the front end portion 312 side. The average deviation value is an average value of distances in the left-right direction between the central portion of the inclined portion 315 and the plurality of polarity change lines Lx. That is, in the inclined portion 315 according to the present embodiment, the water flow path becomes narrower toward the rear end portion 313 serving as the downstream side so as to approach the central portion in the left-right direction. As a result, at the rear end portion 313 of the inclined portion 315, the distance from the valley where the water easily flows to the most distant portion can be shortened, thereby minimizing residual powder detergent in the first accommodation chamber 31.

The water that has flowed into the first water supply chamber 421 is also supplied to the second accommodation chamber 32. When the water level of the water supplied to the second accommodation chamber 32 exceeds the upper end portion of the second cylindrical portion 322, the water in the second accommodation chamber 32 passes through the inside of the second cylindrical portion 322 and is discharged downward of the second accommodation chamber 32 by the siphon principle. The water that has been discharged from the second accommodation chamber 32 flows forward along the bottom plate portion 51 of the bottom cover 5 and is dispensed to the washing machine tank 13.

MODIFIED EXAMPLE

Next, modified examples of the first water supply chamber 421 and the first accommodation chamber 31 will be described. Each modified example described below can be applied by appropriately combining the components of the above-described embodiment or the modified examples. In the following description, the same components as those of the embodiment will be denoted by the same reference signs, and description thereof will be omitted as appropriate.

First Modified Example

In the example described above, each of the plurality of first water supply holes 461 is formed such that the first recessed portion 471 is recessed in the upstream direction of the water flowing on the upper surface of the ceiling portion 41. That is, the plurality of first water supply holes 461 include the first water supply holes 461 in which the first recessed portion 471 is formed toward the rear, and the first water supply holes 461 in which the first recessed portion 471 is formed toward the left, but no limitation is intended. The plurality of first water supply holes 461 may be formed such that the first recessed portions 471 are recessed in the same direction (e.g., rearward).

In the above-described example, the first water supply holes 461 are formed such that, of the three recessed portions 47 (the first recessed portion 471, the second recessed portion 472, and the third recessed portion 473), the recess dimension of the first recessed portion 471 is larger than the recess dimension of each of the second recessed portion 472 and the third recessed portion 473. However, the three recessed portions 47 may have the same recess dimension.

Second Modified Example

In the example described above, the opening shape of the first water supply hole 461 is a recessed shape including the three recessed portions 47 (the first recessed portion 471, the second recessed portion 472, and the third recessed portion 473). However, the opening shape is not limited to this shape and is only required to be a recessed shape including at least one recessed portion 47. For example, the opening shape of the first water supply hole 461 may be any of the shapes illustrated in FIGS. 17A to 17D.

Figure 17A:
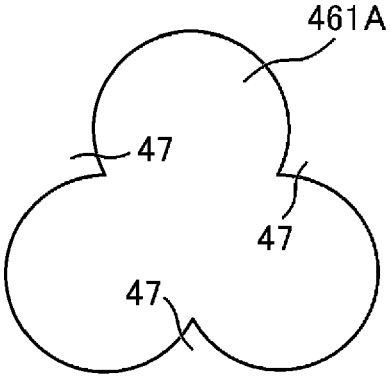
FIG. 17A is a plan view of a first modified example of the first water supply hole.
Figure 17B:
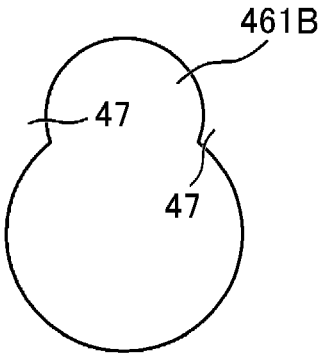
FIG. 17B is a plan view of a first modified example of a second water supply hole.
Figure 17C:
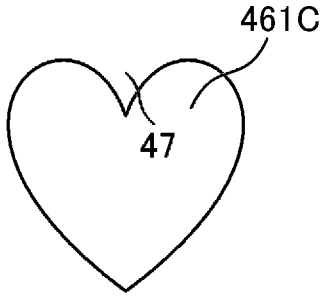
FIG. 17C is a plan view of a first modified example of a third water supply hole.
Figure 17D:
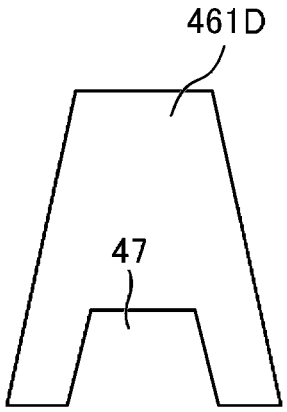
FIG. 17D is a plan view of a first modified example of a fourth water supply hole.

The opening shape of a first water supply hole 461A illustrated in FIG. 17A is a shape in which three circles whose centers are arranged at intervals of approximately 120 degrees partially overlap each other, and is a recessed shape including three recessed portions 47. The opening shape of a first water supply hole 461B illustrated in FIG. 17B is a shape in which two different sized circles whose centers are arranged in a straight line partially overlap each other, and is a recessed shape including two recessed portions 47. The opening shape of a first water supply hole 461C illustrated in FIG. 17C is a so-called heart shape, and is a recessed shape including one recessed portion 47. The opening shape of a first water supply hole 461D illustrated in FIG. 17D is a shape similar to the silhouette of the letter "A", and is a recessed shape including one recessed portion 47.

Third Modified Example

Figure 18:
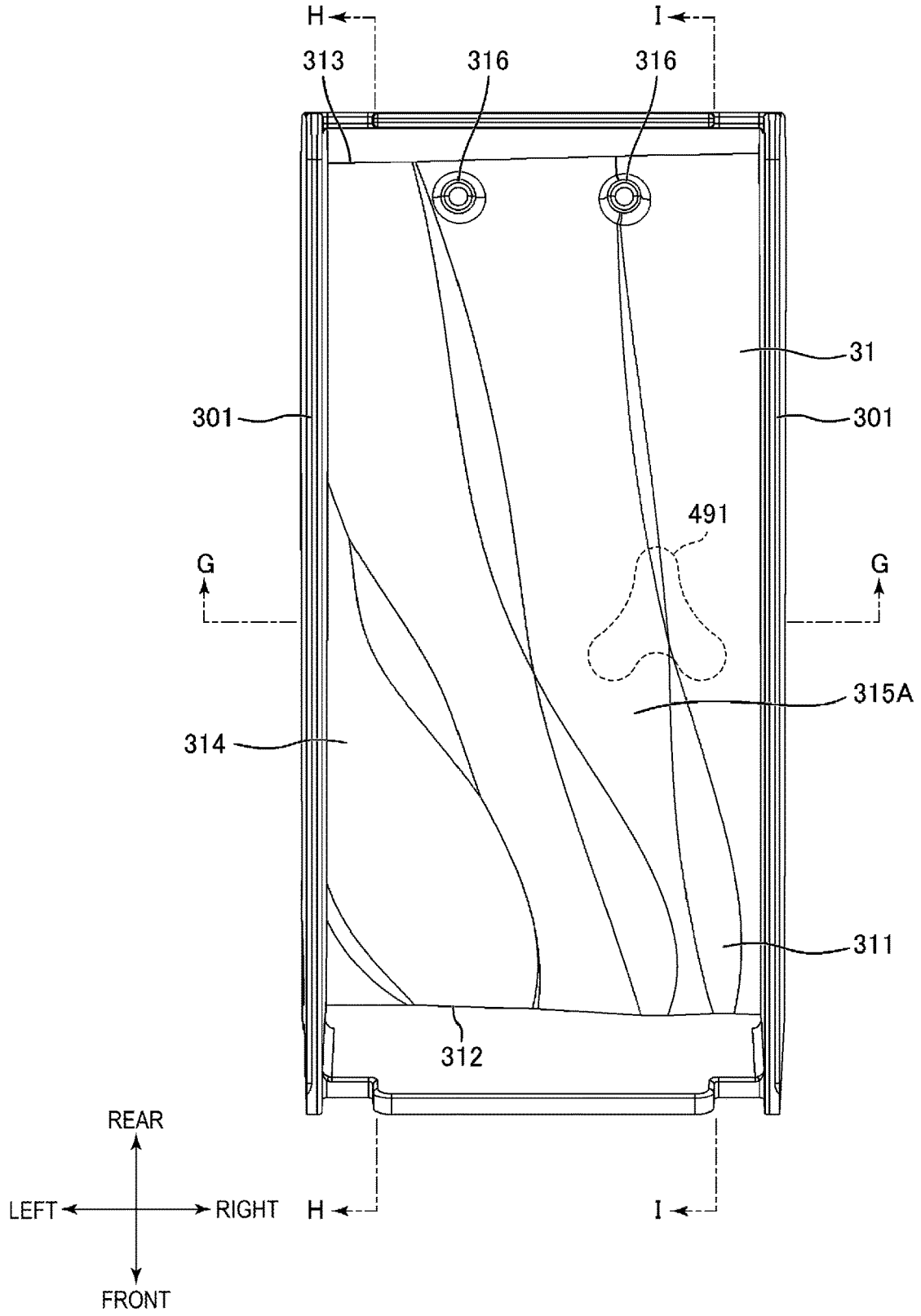
FIG. 18 is a plan view of a first modified example of the first accommodation chamber.
Figure 19:
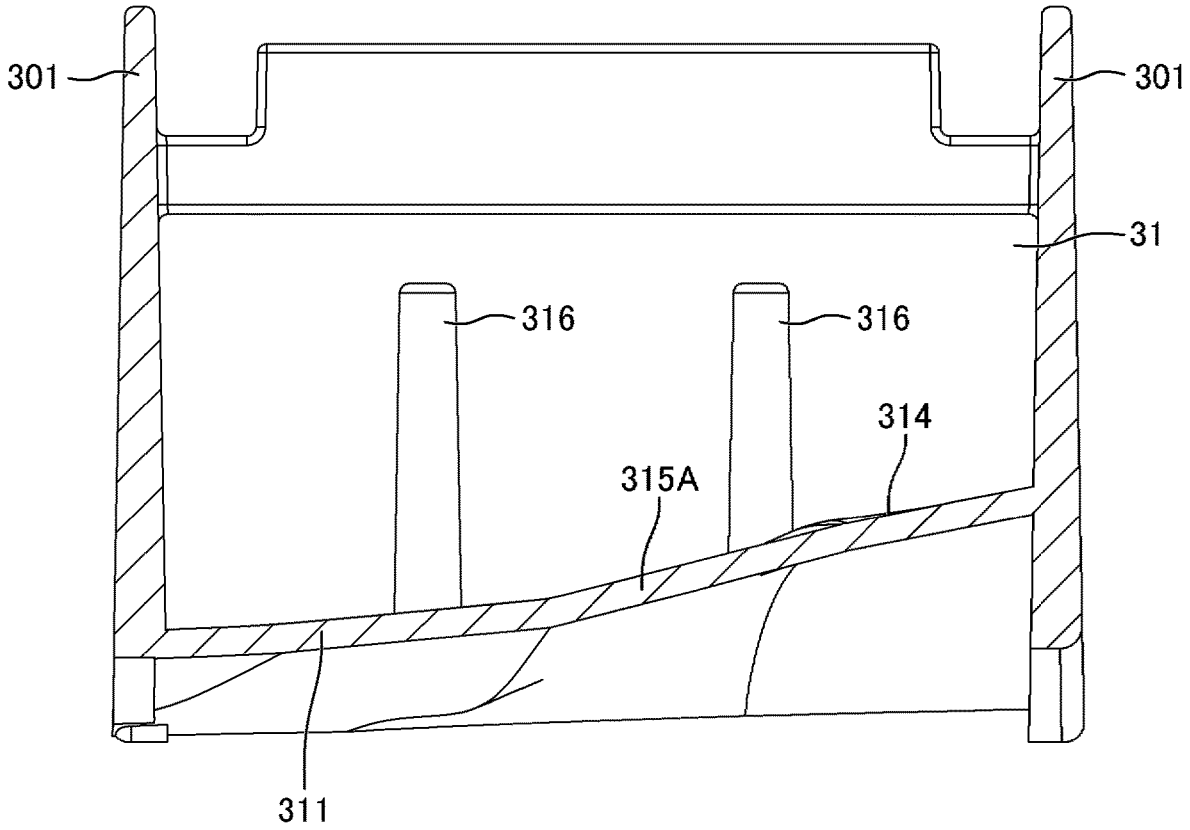
FIG. 19 is a cross-sectional view taken along line G-G in FIG. 18.
Figure 20:
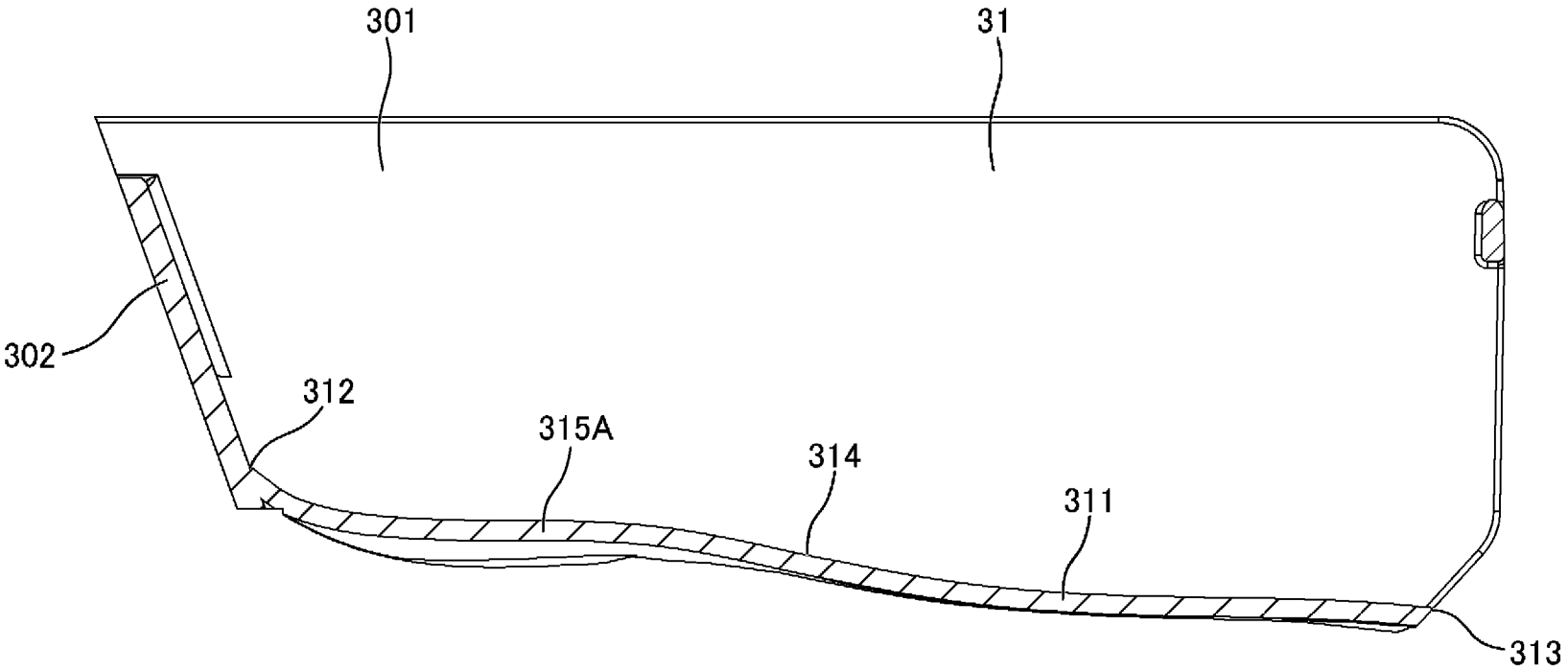
FIG. 20 is a cross-sectional view taken along line H-H in FIG. 18.
Figure 21:
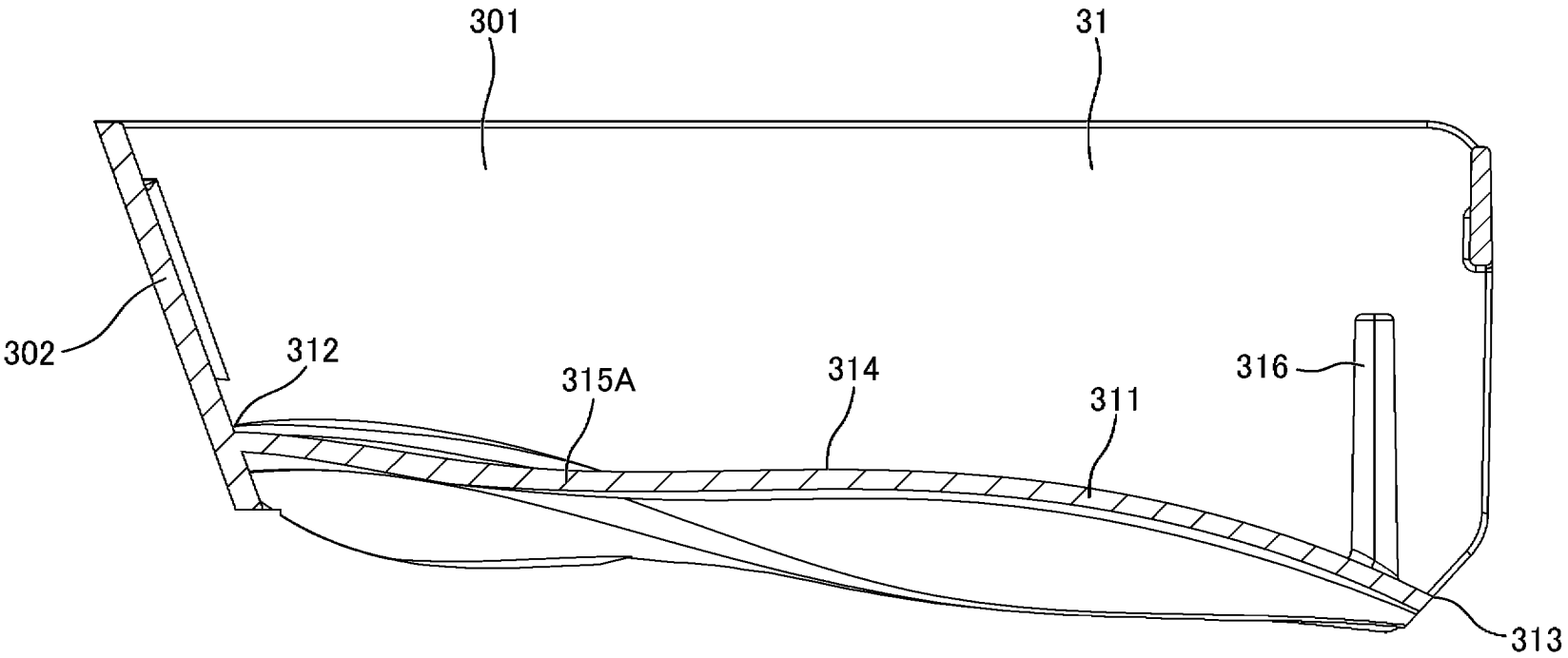
FIG. 21 is a cross-sectional view taken along line I-I in FIG. 18.

A first accommodation chamber 31 according to a third modified example will be described with reference to FIGS. 18 to 21. FIG. 18 is a plan view of the first accommodation chamber 31 according to the third modified example. FIG. 19 is a cross-sectional view taken along line G-G in FIG. 18. FIG. 20 is a cross-sectional view taken along line H-H in FIG. 18. FIG. 21 is a cross-sectional view taken along line I-I in FIG. 18.

As illustrated in FIGS. 18 to 21, the inclined portion 315A of the first accommodation chamber 31 according to the present modified example is different from the inclined portion 315 according to the above-described embodiment in that the inclined portion 315A has a downward gradient that descends with increasing distance in the left-right direction from a position immediately below the first large water supply hole 491 formed in the first water supply chamber 421.

The first large water supply hole 491 is positioned above a central portion of the first accommodation chamber 31 in the front-rear direction and a right end portion. The first large water supply hole 491 has a larger opening area than each of the plurality of first water supply holes 461. Accordingly, the amount of water flowing down through the first large water supply hole 491 is greater than the amount of water flowing down through each of the first water supply holes 461.

In the inclined portion 315A according to the present modified example, a downward gradient is formed that descends in the left-right direction from a position immediately below the first large water supply hole 491. In the present modified example, this configuration can further increase the flow velocity of a large amount of water flowing down from the first large water supply hole 491. Thus, it is possible to minimize residual powder detergent accommodated in the first accommodation chamber 31.

In addition, as illustrated in FIGS. 20 and 21, the inclined portion 315A has a downward gradient that descends from the front end portion 312 toward the rear end portion 313 in the front-rear direction. That is, the inclined portion 315A does not include an upward gradient in the front-rear direction. This can minimize residual powder detergent and water.

Fourth Modified Example

As illustrated in FIGS. 5 to 11, the inclined portion 315 of the first accommodation chamber 31 according to the above-described embodiment is formed such that the water flow path is narrowed so as to approach the central portion in the left-right direction toward the rear end portion 313 serving as the downstream side, but no limitation is intended.

Figure 22:
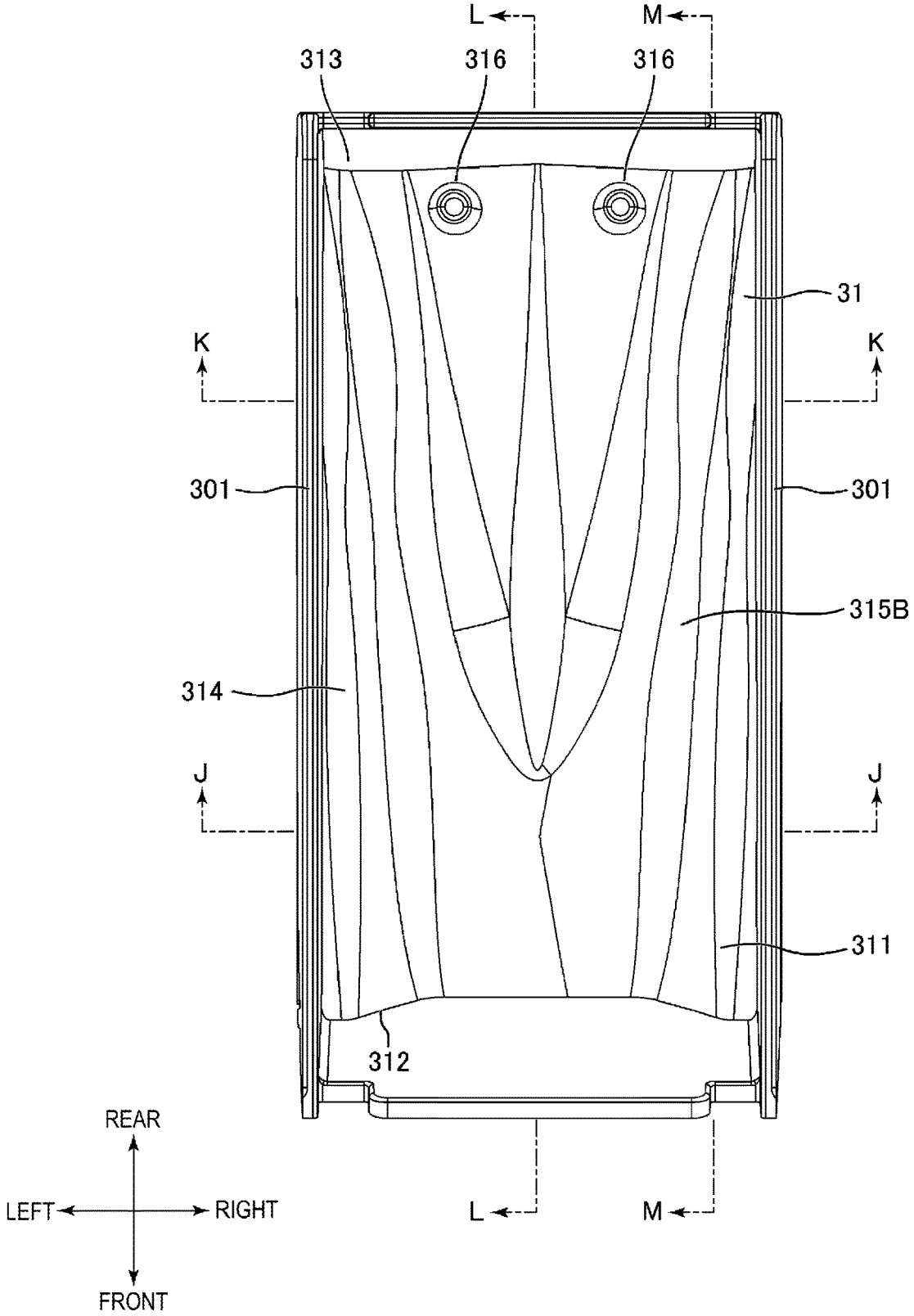
FIG. 22 is a plan view of a second modified example of the first accommodation chamber.
Figure 23:
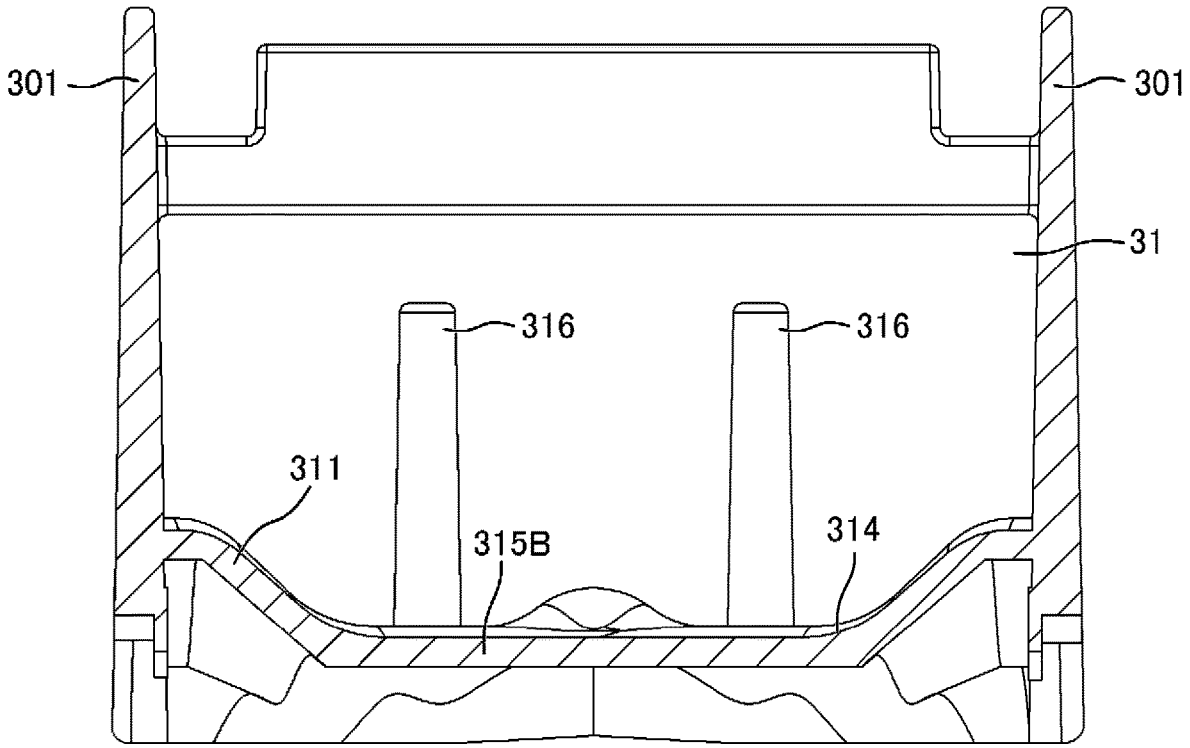
FIG. 23 is a cross-sectional view taken along line J-J in FIG. 22.
Figure 24:
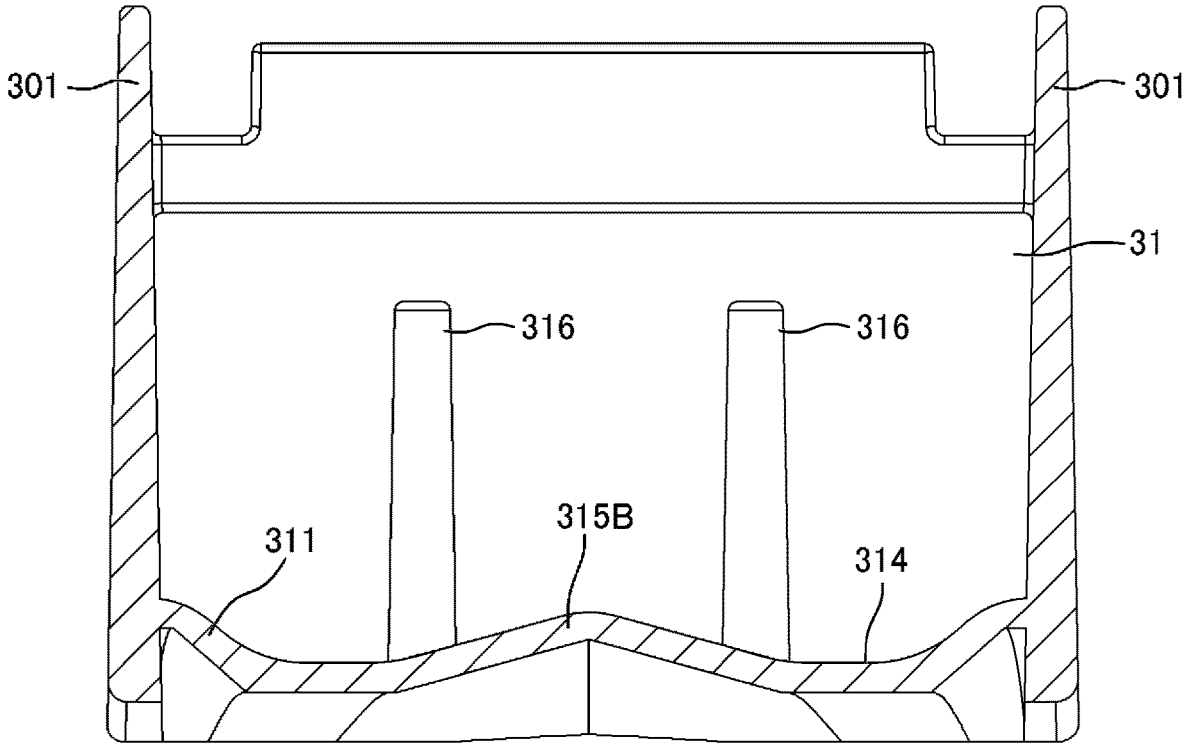
FIG. 24 is a cross-sectional view taken along line K-K in FIG. 22.
Figure 25:
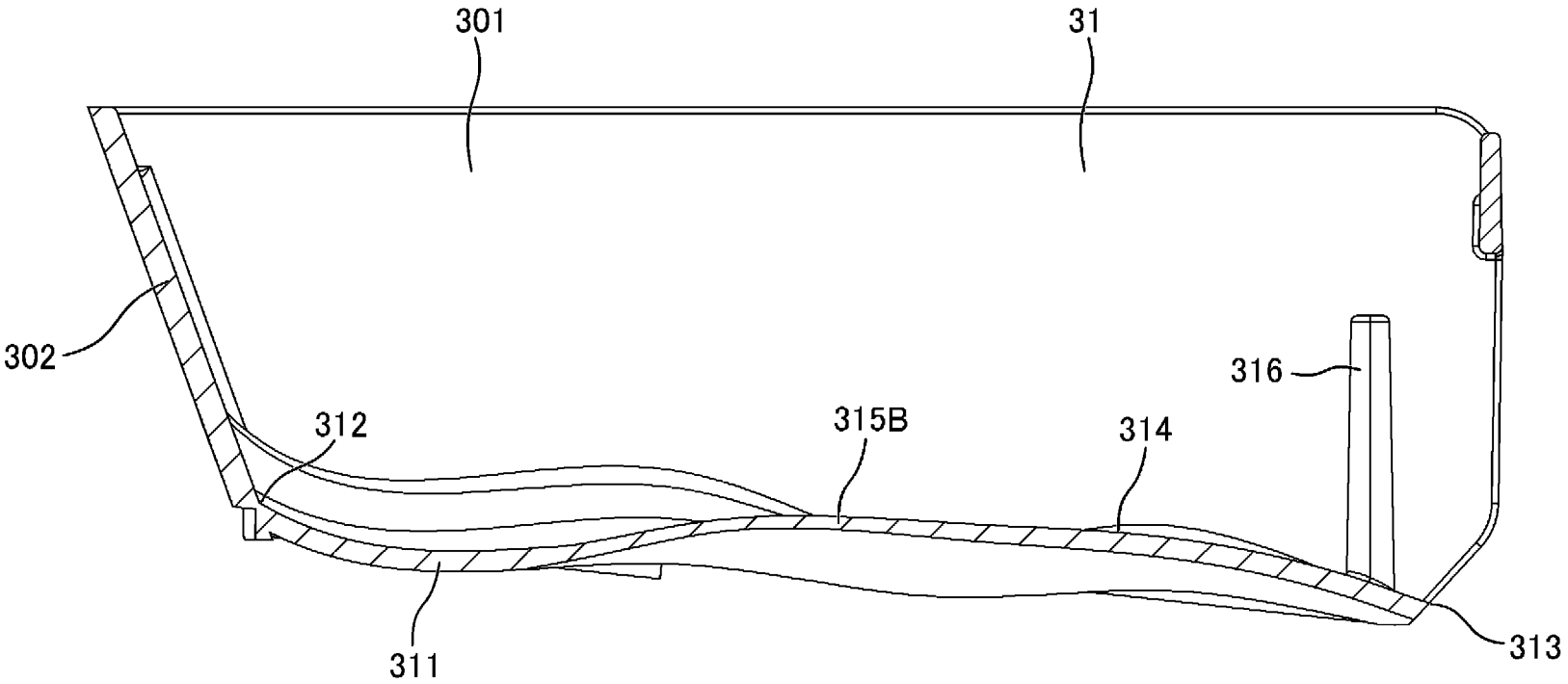
FIG. 25 is a cross-sectional view taken along line L-L in FIG. 22.
Figure 26:
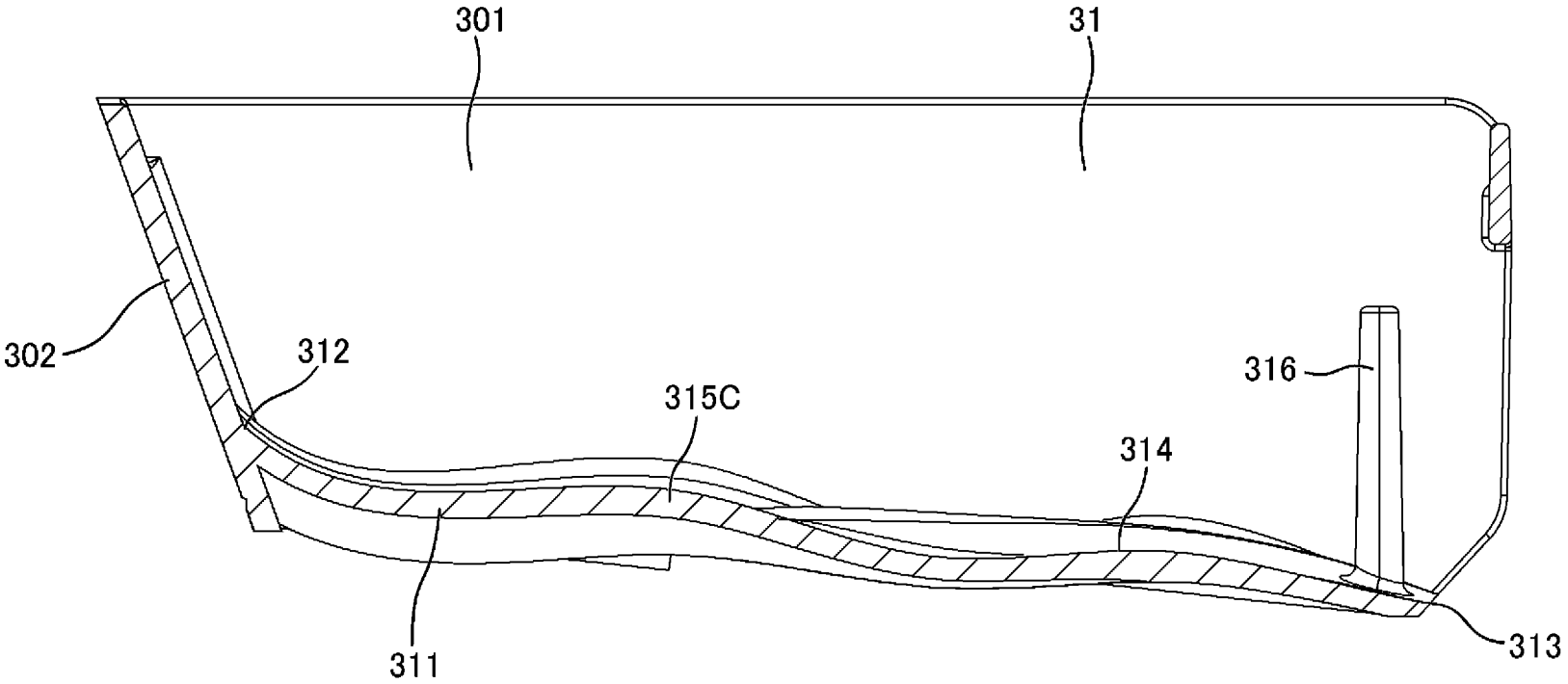
FIG. 26 is a cross-sectional view taken along line M-M in FIG. 22.

A first accommodation chamber 31 according to a fourth modified example will be described with reference to FIGS. 22 to 26. FIG. 22 is a plan view of the first accommodation chamber 31 according to the fourth modified example. FIG. 23 is a cross-sectional view taken along line J-J in FIG. 22. FIG. 24 is a cross-sectional view taken along line K-K in FIG. 22. FIG. 25 is a cross-sectional view taken along line L-L in FIG. 22. FIG. 26 is a cross-sectional view taken along line M-M in FIG. 22.

As illustrated in FIGS. 22 to 26, an inclined portion 315B of the first accommodation chamber 31 according to the present modified example is formed such that a valley serving as a water flow path is branched into two. In the inclined portion 315B, the water flow path is branched into two so as to approach both end portions in the left-right direction toward the rear end portion 313 serving as the downstream side. Thus, in the present modified example, the two water flow paths are formed at the rear end portion 313 of the first accommodation chamber 31, which can minimize residual powder detergent at the rear end portion 313 of the first accommodation chamber 31.

Supplement

A case 2 according to a first aspect accommodates the washing treatment agent to be dispensed to the washing machine tank 13 of the washing machine 1. The case 2 includes the main body portion 3 and the water supply portion 4. The main body portion 3 includes the first bottom portion 311 receiving the washing treatment agent. The water supply portion 4 supplies water to the main body portion 3. The first bottom portion 311 includes the first upper surface 314 formed such that the one end portion (front end portion 312) in the first direction (front-rear direction) is located above the other end portion (rear end portion 313). The first upper surface 314 includes the inclined portion 315 (315A, 315B) having the first gradient varying in the first direction, the first gradient indicating a ratio of a distance in the vertical direction to a distance in the first direction.

A case 2 according to a second aspect is the case 2 according to the first aspect, in which the first gradient of the inclined portion 315 (315B) continuously varies so as to repeatedly increase and decrease in the first direction.

A case 2 according to a third aspect is the case 2 according to the first aspect or the second aspect, in which the inclined portion 315 (315A, 315B) has the second gradient varying in the second direction (left-right direction) intersecting the first direction, the second gradient indicating a ratio of a distance in the vertical direction to a distance in the second direction.

A case 2 according to a fourth aspect is the case 2 according to the third aspect, in which the inclined portion 315 (315A, 315B) has the second gradient varying so as to repeatedly increase and decrease in the second direction. An interval in the second direction between the plurality of polarity change points at which the polarity of the second gradient changes is referred to as a polarity change interval. The inclined portion 315 is formed such that the polarity change interval on the other end portion side is narrower than the polarity change interval on the one end portion side.

A case 2 according to a fifth aspect is a case according to a fourth aspect, in which an average value of distances in the second direction between the center of the first upper surface 314 and the plurality of polarity change points at which the polarity of the second gradient changes is referred to as an average deviation value. The inclined portion 315 (315A, 315B) is formed such that the average deviation value on the other end portion side is smaller than the average deviation value on the one end portion side.

A case 2 according to a sixth aspect is the case 2 according to any one of the first to fifth aspects, in which the inclined portion 315A has a downward gradient descending from the one end portion toward the other end portion in the first direction.

A case 2 according to a seventh aspect is the case 2 according to any one of the first to sixth aspects, in which the plurality of first water supply holes 461 (461A to 461D) and the first large water supply hole 491 are formed in the water supply portion 4. Through the plurality of first water supply holes 461 (461A to 461D), water flows in the vertical direction toward the main body portion 3. The first large water supply hole 491 has an opening area larger than that of each of the plurality of first water supply holes 461 (461A to 461D) and allows water to pass therethrough in the vertical direction. In the second direction intersecting the first direction, the inclined portion 315A has a downward gradient descending with increasing distance in the second direction from a position immediately below the first large water supply hole 491.

A washing machine 1 according to an eighth aspect includes the case 2 according to any one of the first to seventh aspects, and the washing machine tank 13 into which the washing treatment agent accommodated in the case 2 is dispensed together with water.

A case 2 according to a ninth aspect accommodates the washing treatment agent to be dispensed to the washing machine tank 13 of the washing machine 1. The case 2 includes the main body portion 3 and the water supply portion 4. The main body portion 3 is open at the top and receives the washing treatment agent. The water supply portion 4 includes the ceiling portion 41 covering the top of the main body portion 3. The ceiling portion 41 includes the upper surface 411 on which water to be supplied to the main body portion 3 flows, and the plurality of first water supply holes 461 (461A to 461D) through which the water passes in the vertical direction are formed in the ceiling portion 41. The opening shape of at least one first water supply hole 461 (461A to 461D) of the plurality of first water supply holes 461 (461A to 461D) is a recessed shape including at least one recessed portion 47 recessed toward the inside of the first water supply hole 461 (461A to 461D).

A case 2 according to a tenth aspect is the case 2 according to the ninth aspect, in which the opening shape of the at least one first water supply hole 461 (461A to 461D) is constricted by the at least one recessed portion 47.

A case 2 according to an eleventh aspect is the case 2 according to the ninth or tenth aspect, in which the at least one recessed portion 47 is formed by a curved line.

A case 2 according to a twelfth aspect is the case 2 according to any one of the ninth to eleventh aspects, in which the opening peripheral edge of the at least one first water supply hole 461 (461A to 461D) is formed by a curved line.

A case 2 according to a thirteenth aspect is the case 2 according to any one of the ninth to twelfth aspects, in which the at least one recessed portion 47 is recessed in a direction different from a direction of water flowing on the upper surface 411 of the ceiling portion 41.

A case 2 according to a fourteenth aspect is the case 2 according to any one of the ninth to thirteenth aspects, in which the at least one recessed portion 47 includes the plurality of recessed portions 47. The opening shape of the at least one first water supply hole 461 is a recessed shape including the plurality of recessed portions 47.

A case 2 according to a fifteenth aspect is the case 2 according to the fourteenth aspect, in which the plurality of recessed portions 47 are the first recessed portion 471, the second recessed portion 472, and the third recessed portion 473 that are recessed in mutually different directions. The first recessed portion 471 is formed so as to be recessed in the first direction. The second recessed portion 472 is formed on one side of the first recessed portion 471 in the second direction intersecting the first direction. The third recessed portion 473 is formed on the other side of the first recessed portion 471 in the second direction.

A case 2 according to a sixteenth aspect is the case 2 according to the fifteenth aspect, in which the first recessed portion 471 is formed so as to be recessed in the upstream direction of the water flowing on the upper surface 411 of the ceiling portion 41.

A case 2 according to a seventeenth aspect is the case 2 according to any one of the ninth to sixteenth aspects, in which the first large water supply hole 491 through which water passes in the vertical direction is further formed in the ceiling portion 41. The opening area of the first large water supply hole 491 is larger than the opening area of the at least one first water supply hole 461.

A case 2 according to an eighteenth aspect is the case according to the seventeenth aspect, in which the opening shape of the first large water supply hole 491 is the same as the opening shape of the at least one first water supply hole 461.

A case 2 according to a nineteenth aspect is the case 2 according to any one of the ninth to eighteenth aspects, in which the water supply portion 4 further includes at least one rib 481 protruding upward from the outer peripheral edge of the at least one first water supply hole 461 (461A to 461D).

A case 2 according to a twentieth aspect is the case 2 according to any one of the ninth to nineteenth aspects, in which the corner of the outer peripheral edge of the at least one first water supply hole 461 (461A to 461D) is cut off.

The washing machine 1 according to a twenty-first aspect includes the case 2 according to any one of the ninth to twentieth aspects, and the washing machine tank 13 into which the washing treatment agent accommodated in the case 2 is dispensed together with water.

Note that the present disclosure includes a technical concept of focusing on the shape of the mouth of an archerfish. The present disclosure also includes the technical concept of focusing on the shape of the nest of torquigener albomaculosus. In other words, the present disclosure relates to biomimetics.

The invention claimed is:

1. A case accommodating a washing treatment agent to be dispensed to a washing machine tank of a washing machine, the case comprising:

a main body portion including a bottom portion configured to receive the washing treatment agent; and a water supply portion configured to supply water to the main body portion, wherein the bottom portion includes an upper surface including one end portion, the one end portion being positioned above another end portion in a first direction, the upper surface further includes an inclined portion having a first gradient varying in the first direction, the first gradient indicating a ratio of a distance in a vertical direction to a distance in the first direction, the inclined portion includes at least one increasing portion, the first gradient of the at least one increasing portion in the first direction increasing in a downward direction from the one end portion toward the other end portion in the first direction, the inclined portion further includes at least one decreasing portion, the first gradient of the at least one decreasing portion in the first direction decreasing in the downward direction from the one end portion toward the other end portion in the first direction, the inclined portion further includes a gradient portion that is a downward gradient descending from a side of the one end portion toward a side of the other end portion in the first direction, and the gradient portion includes a largest part where the gradient portion changes from an upward gradient to a downward gradient in a second direction intersecting the first direction.

2. The case according to claim 1, wherein the first gradient of the inclined portion continuously varies in the first direction, the first gradient repeatedly increasing and decreasing.

3. The case according to claim 1, wherein a second gradient of the inclined portion varies in the second direction, the second gradient indicating a ratio of a distance in the vertical direction to a distance in the second direction.

4. The case according to claim 3, wherein the second gradient of the inclined portion varies in the second direction, the second gradient repeatedly increasing and decreasing, an interval in the second direction between a plurality of polarity change points at which a polarity of the second gradient changes is referred to as a polarity change interval, and in the inclined portion, the polarity change interval on the side of the other end portion is narrower than the polarity change interval on the side of the one end portion.

5. The case according to claim 1, wherein the inclined portion is a downward gradient descending from the one end portion toward the other end portion in the first direction.

6. A washing machine comprising:

the case according to claim 1; and the washing machine tank into which the washing treatment agent accommodated in the case is dispensed together with the water.

7. A case accommodating a washing treatment agent to be dispensed to a washing machine tank of a washing machine, the case comprising:

a main body portion including a bottom portion configured to receive the washing treatment agent; and a water supply portion configured to supply water to the main body portion, wherein the bottom portion includes an upper surface including one first end portion, the one first end portion being positioned above another first end portion in a first direction, the upper surface further includes an inclined portion having a first gradient varying in the first direction, the first gradient indicating a ratio of a distance in a vertical direction to a distance in the first direction, the inclined portion includes three or more portions having a second gradient increasing or decreasing in a second direction orthogonal to the first direction, the second gradient indicating a ratio of a distance in the vertical direction to a distance in the second direction, and the inclined portion is a downward gradient descending from a side of one second end portion toward a side of another second end portion in the second direction.

8. The case according to claim 7, wherein the second gradient of the inclined portion varies in the second direction, the second gradient repeatedly increasing and decreasing.

9. A case accommodating a washing treatment agent to be dispensed to a washing machine tank of a washing machine, the case comprising:

a main body portion including a bottom portion configured to receive the washing treatment agent; and a water supply portion configured to supply water to the main body portion, wherein the bottom portion includes an upper surface including one end portion, the one end portion being positioned above another end portion in a first direction, the upper surface further includes an inclined portion having a first gradient varying in the first direction, the first gradient indicating a ratio of a distance in a vertical direction to a distance in the first direction, the inclined portion includes three or more portions having a second gradient increasing or decreasing in a second direction intersecting the first direction, the second gradient indicating a ratio of a distance in the vertical direction to a distance in the second direction, the second gradient of the inclined portion varies in the second direction, the second gradient repeatedly increasing and decreasing, an interval in the second direction between a plurality of polarity change points at which a polarity of the second gradient changes is referred to as a polarity change interval, and in the inclined portion, the polarity change interval on a side of the other end portion is narrower than the polarity change interval on a side of the one end portion.

10. The case according to claim 4, wherein an average value of distances in the second direction between a center of the upper surface and the plurality of polarity change points at which the polarity of the second gradient changes is referred to as an average deviation value, and in the inclined portion, the average deviation value on the side of the other end portion is smaller than the average deviation value on the side of the one end portion.

11. The case according to claim 7, wherein a plurality of water supply holes and a large water supply hole are formed in the water supply portion, the plurality of water supply holes being configured to allow water to flow in the vertical direction toward the main body portion through the plurality of water supply holes, the large water supply hole being configured to allow the water to flow in the vertical direction through the large water supply hole, the large water supply hole having an opening area larger than an opening area of each of the plurality of water supply holes, and the downward gradient descending with increasing distance in the second direction from a position immediately below the large water supply hole.

* * * * *